US009995529B1

(12) United States Patent
Banks

(10) Patent No.: US 9,995,529 B1
(45) Date of Patent: Jun. 12, 2018

(54) TEMPERATURE-REGULATING CONTAINMENT SYSTEM

(71) Applicant: Nova Laboratories, Firestone, CO (US)

(72) Inventor: Robert Banks, Firestone, CO (US)

(73) Assignee: Nova Laboratories, Firestone, CO (US)

( * ) Notice: Subject to any disclaimer, the term of this patent is extended or adjusted under 35 U.S.C. 154(b) by 63 days.

(21) Appl. No.: 15/373,186

(22) Filed: Dec. 8, 2016

(51) Int. Cl.
*F25B 29/00* (2006.01)
*F25D 31/00* (2006.01)
*F25B 21/02* (2006.01)
*F25D 29/00* (2006.01)

(52) U.S. Cl.
CPC ..... *F25D 31/005* (2013.01); *F25B 21/02* (2013.01); *F25D 29/00* (2013.01); *F25D 31/008* (2013.01); *F25B 2321/0251* (2013.01); *F25D 2201/14* (2013.01); *F25D 2400/02* (2013.01); *F25D 2400/361* (2013.01); *F25D 2700/12* (2013.01)

(58) Field of Classification Search
CPC ..... F25D 31/005; F25D 29/00; F25D 31/008; F25D 2400/361; F25D 2400/02; F25D 2700/12; F25D 2201/14; F25B 21/02; F25B 2321/0251
USPC ..... 165/253
See application file for complete search history.

(56) References Cited

U.S. PATENT DOCUMENTS 5,603,858 A * 2/1997 Wyatt ..... A47J 39/006 126/246
5,959,433 A * 9/1999 Rohde ..... H02J 50/10 320/108
6,072,161 A * 6/2000 Stein ..... A47G 19/2288 219/386
6,140,614 A * 10/2000 Padamsee ..... A47J 36/2466 219/438
6,144,016 A * 11/2000 Garvin ..... A45C 11/20 206/550
6,279,470 B2 * 8/2001 Simeray ..... A47J 39/006 165/48.1
6,281,611 B1 * 8/2001 Chen ..... A47J 36/26 219/201
6,376,803 B1 * 4/2002 Klinger ..... A47J 39/006 219/386

(Continued)

FOREIGN PATENT DOCUMENTS

WO WO 2008/155538 12/2008

*Primary Examiner* — Claire Rojohn, III
(74) *Attorney, Agent, or Firm* — Craig R. Miles; CR Miles P.C.

(57) ABSTRACT

Disclosed herein are embodiments of a temperature-regulating containment system for actively heating or cooling a liquid to a desired liquid temperature, the temperature-regulating containment system comprising: a container having an internal cavity defined by a sidewall upwardly extending from a bottom wall; a heating element disposed beneath the bottom wall; a chamber disposed beneath the bottom wall, the chamber adjustable between an unfilled condition and a filled condition in which the chamber is filled with a heat transfer medium; and a cooling element disposed beneath the chamber. When the liquid temperature is below the desired liquid temperature: the chamber adjusts to the unfilled condition, and the heating element provides heat to the bottom wall. When the liquid temperature is above the desired liquid temperature: the chamber adjusts to the filled condition, and the cooling element removes heat from the bottom wall.

15 Claims, 25 Drawing Sheets

(56) References Cited

U.S. PATENT DOCUMENTS 6,634,417 B1 * 10/2003 Kolowich ..... A47G 19/127 165/10
6,674,052 B1 * 1/2004 Luo ..... A47J 41/0077 219/432
6,703,590 B1 * 3/2004 Holley, Jr. ..... A47J 36/2433 126/265
6,818,867 B2 * 11/2004 Kressmann ..... A47J 27/21083 219/438
6,852,954 B1 * 2/2005 Liu ..... A47J 41/005 219/387
6,870,135 B2 * 3/2005 Hamm ..... A47J 36/2433 219/202
6,968,888 B2 * 11/2005 Kolowich ..... A47G 19/127 165/10
7,034,256 B1 * 4/2006 Phillips ..... A47J 36/04 126/261
7,073,678 B1 * 7/2006 Dibdin ..... A47G 19/2272 220/254.1
7,091,455 B2 * 8/2006 Fung ..... A47J 27/2105 219/429
7,109,445 B2 * 9/2006 Patterson ..... A47J 27/004 219/438
7,276,676 B1 * 10/2007 Thompson ..... A47J 36/2483 206/541
7,571,830 B2 * 8/2009 Lin ..... A47J 41/0016 206/217
7,683,572 B2 * 3/2010 Toya ..... H02J 7/0044 320/108
7,997,786 B2 * 8/2011 Liu ..... A47J 27/004 219/438
8,055,310 B2 * 11/2011 Beart ..... G06F 1/1632 455/572
8,076,620 B2 * 12/2011 Maupin ..... A47J 27/004 219/432
8,618,448 B2 12/2013 Alexander
8,759,721 B1 6/2014 Alexander
9,035,222 B2 5/2015 Alexander
9,642,191 B2 * 5/2017 Everett, Jr. ..... H05B 3/68
D799,268 S * 10/2017 Gschwandtl ..... D7/509
9,782,036 B2 * 10/2017 Alexander ..... A47J 36/2433
9,801,482 B1 * 10/2017 Alexander ..... A47J 41/0044
9,814,331 B2 * 11/2017 Alexander ..... A47G 19/027
9,839,324 B2 * 12/2017 Xiao ..... H05B 3/0014
9,854,824 B2 * 1/2018 Everett, Jr. ..... A23L 5/10
9,863,695 B2 * 1/2018 Alexander ..... F25D 31/005
9,885,526 B2 * 2/2018 Maranville ..... F28F 7/02
2001/0022304 A1 * 9/2001 Roche ..... B65D 43/0229 220/212
2001/0023866 A1 * 9/2001 Wang ..... A47J 27/004 219/429
2002/0043070 A1 * 4/2002 Bedard ..... B67D 1/0043 62/68
2002/0104318 A1 * 8/2002 Jaafar ..... A61J 1/165 62/3.6
2002/0175158 A1 * 11/2002 Sanoner ..... A47G 19/2227 219/387
2003/0029862 A1 * 2/2003 Clothier ..... A47C 1/12 219/621
2003/0074903 A1 * 4/2003 Upadhye ..... A47J 36/2438 62/3.3
2004/0167592 A1 * 8/2004 Grove ..... A61B 18/082 607/96
2005/0121431 A1 * 6/2005 Yuen ..... A47G 19/2288 219/387
2006/0081599 A1 * 4/2006 Anderson ..... A47J 36/2433 219/438
2006/0168983 A1 * 8/2006 Tatsui ..... F25C 1/10 62/340
2006/0173259 A1 * 8/2006 Flaherty ..... A61B 5/0031 600/331
2006/0207442 A1 * 9/2006 Pettersson ..... F25B 21/02 99/517
2006/0209628 A1 * 9/2006 Jones ..... B01F 13/0818 366/273
2006/0261233 A1 * 11/2006 Williams ..... A47G 19/2227 248/311.2
2007/0053407 A1 * 3/2007 Kinsler ..... G01K 1/14 374/208
2007/0151457 A1 * 7/2007 Rabin ..... A47J 27/21008 99/275
2007/0199333 A1 * 8/2007 Windisch ..... A41D 13/0051 62/3.5
2007/0223895 A1 * 9/2007 Flemm ..... A47J 36/2433 392/441
2008/0019122 A1 * 1/2008 Kramer ..... A47G 19/025 362/154
2008/0141681 A1 * 6/2008 Arnold ..... A41D 13/005 62/3.5
2008/0149624 A1 * 6/2008 Tamura ..... H02J 7/00 219/685
2008/0213449 A1 * 9/2008 Wisner ..... A47J 39/006 426/520
2008/0251063 A1 * 10/2008 Palena ..... A47J 36/2416 126/263.09
2009/0049845 A1 * 2/2009 McStravick ..... F25B 21/02 62/3.62
2009/0071981 A1 * 3/2009 Scardino ..... F25B 21/02 222/146.6
2009/0102296 A1 * 4/2009 Greene ..... H01Q 1/243 307/149
2009/0166350 A1 * 7/2009 Ho ..... A47J 27/21041 219/441
2009/0184102 A1 * 7/2009 Parker, Jr. ..... A47J 36/2472 219/387
2010/0000980 A1 * 1/2010 Popescu ..... A47J 36/20 219/201
2010/0158489 A1 * 6/2010 Siu ..... A47J 27/2105 392/444
2010/0307168 A1 * 12/2010 Kohl ..... F25B 21/02 62/3.6
2011/0016886 A1 * 1/2011 Ghoshal ..... F25B 21/02 62/3.2
2011/0072978 A1 * 3/2011 Popescu ..... A47G 19/14 99/288
2011/0121660 A1 * 5/2011 Azancot ..... H02J 50/10 307/104
2011/0259871 A1 * 10/2011 Li ..... A47J 27/21158 219/441
2012/0090333 A1 * 4/2012 DellaMorte, Jr. ..... F25B 21/02 62/3.62
2012/0103562 A1 * 5/2012 Alexander ..... A47J 36/2466 165/64
2012/0132646 A1 * 5/2012 England ..... H05B 6/062 219/622
2012/0193999 A1 * 8/2012 Zeine ..... H02J 7/025 307/104
2012/0235505 A1 * 9/2012 Schatz ..... H03H 7/40 307/104
2012/0258229 A1 * 10/2012 Mindrup ..... A21D 8/06 426/556
2013/0103463 A1 * 4/2013 Briar ..... B65D 25/02 705/14.4
2013/0200064 A1 * 8/2013 Alexander ..... A47G 19/2288 219/441
2013/0221013 A1 * 8/2013 Kolowich ..... A47J 36/2444 220/592.17
2013/0255824 A1 * 10/2013 Williams ..... B65D 81/18 141/1
2014/0165607 A1 * 6/2014 Alexander ..... A47G 19/2288 62/3.3
2014/0239010 A1 * 8/2014 Hwang ..... F25D 23/126 222/23
2014/0305927 A1 * 10/2014 Alexander ..... A47G 19/027 219/387
2015/0024349 A1 * 1/2015 Bischoff ..... A47G 23/16 434/127
2015/0122688 A1 * 5/2015 Dias ..... A47G 19/025 206/459.1

(56) References Cited

U.S. PATENT DOCUMENTS

| | | | | |
|---|---|---|---|---|
| 2015/0245723 | A1* | 9/2015 | Alexander | A47G 19/027 99/483 |
| 2015/0335184 | A1* | 11/2015 | Balachandran | A47G 19/2288 219/438 |
| 2016/0045047 | A1* | 2/2016 | Healy | A47G 19/2288 220/592.16 |
| 2017/0146288 | A1* | 5/2017 | Hwang | F25D 29/005 |
| 2017/0160007 | A1* | 6/2017 | Liptak | F25D 31/007 |

* cited by examiner

TEMPERATURE-REGULATING CONTAINMENT SYSTEM

I. SUMMARY OF THE INVENTION

A broad object of a particular embodiment of the invention can be to provide a temperature-regulating containment system for actively heating or cooling a liquid to a desired liquid temperature, and methods of making and using such a temperature-regulating containment system, whereby the temperature-regulating containment system comprises: a container having an internal cavity defined by a sidewall upwardly extending from a bottom wall, the internal cavity configured to contain the liquid which has a liquid temperature; a heating element disposed beneath the bottom wall, the heating element configured to provide heat to the bottom wall; a chamber disposed beneath the bottom wall, the chamber adjustable between an unfilled condition and a filled condition in which the chamber is filled with a heat transfer medium; and a cooling element disposed beneath the chamber, the cooling element configured to remove heat from the bottom wall; wherein when the liquid temperature is below the desired liquid temperature: the chamber adjusts to the unfilled condition, and the heating element provides heat to the bottom wall to heat the liquid to the desired liquid temperature; and wherein when the liquid temperature is above the desired liquid temperature: the chamber adjusts to the filled condition, and the cooling element removes heat from the bottom wall to cool the liquid to the desired liquid temperature.

Naturally, further objects of the invention are disclosed throughout other areas of the specification, drawings, and claims.

II. BRIEF DESCRIPTION OF THE DRAWINGS

Figure 2A:
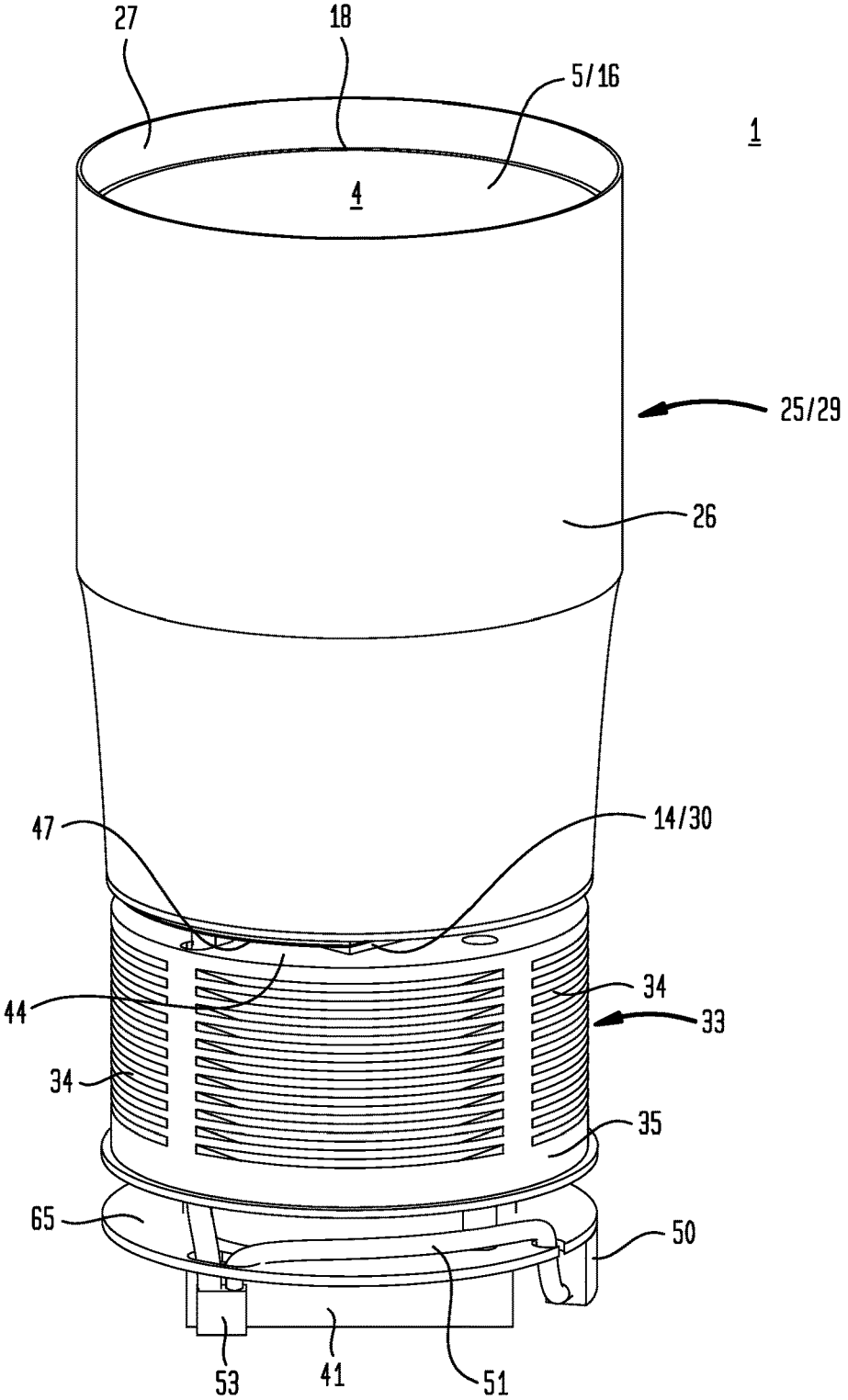
FIG. 2A is a perspective view of a particular embodiment of the instant temperature-regulating containment system.
Figure 2B:
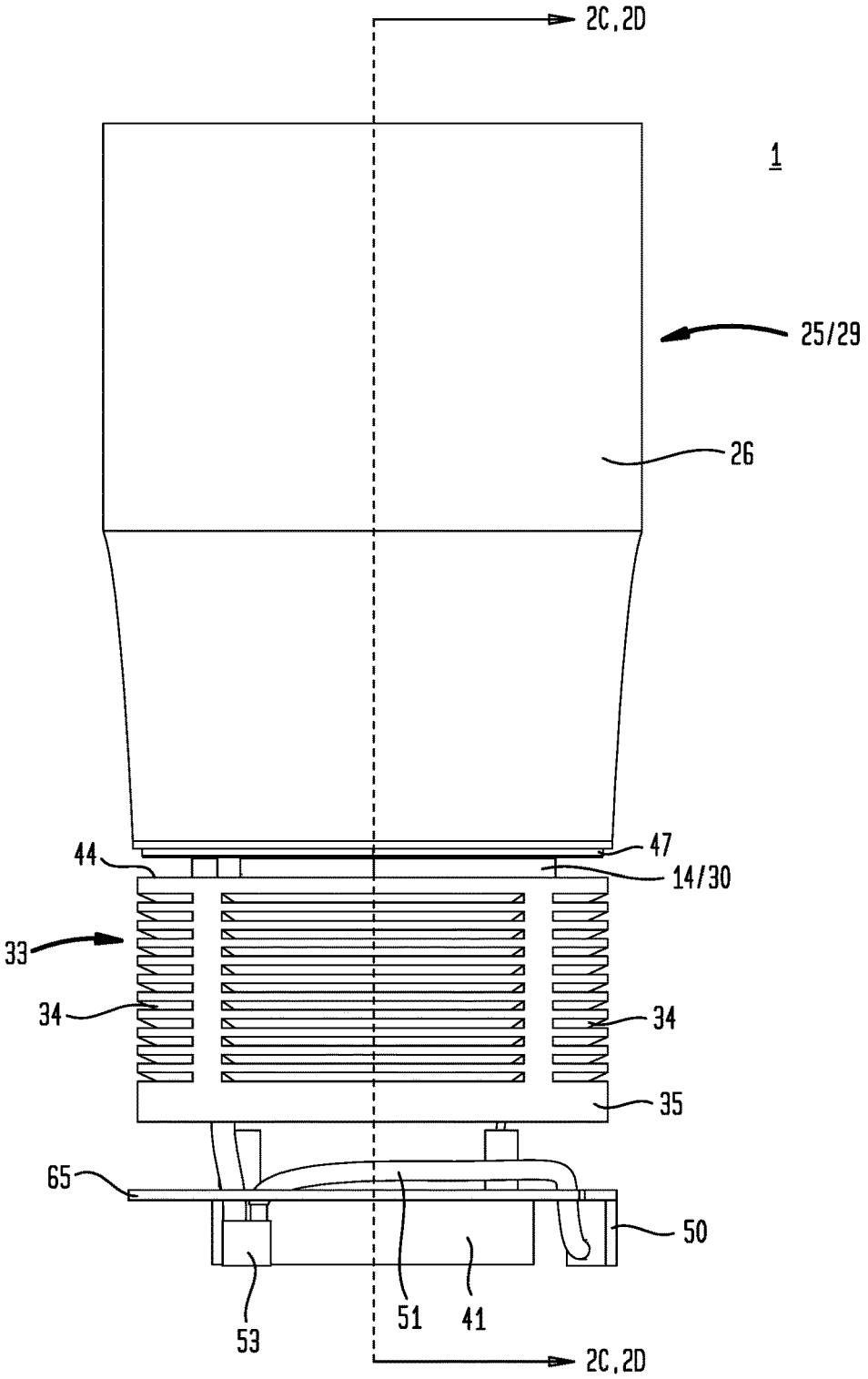
FIG. 2B is a front view of the particular embodiment of the instant temperature-regulating containment system shown in FIG. 2A.
Figure 2C:
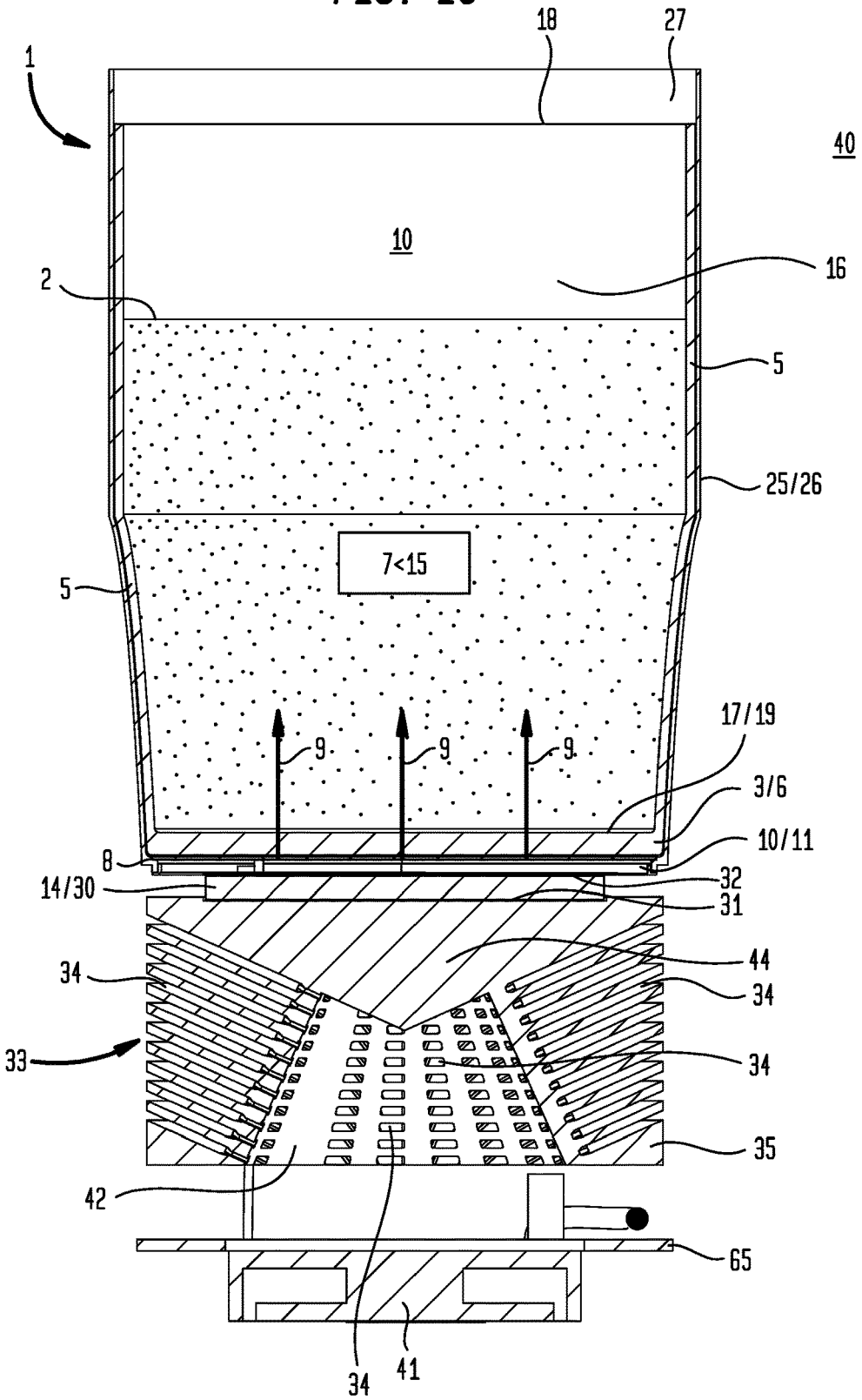

FIG. 2C is a cross-sectional view 2C-2C of the particular embodiment of the instant temperature-regulating containment system shown in FIG. 2B, whereby the liquid temperature of the liquid contained within the internal cavity of the container is below a desired liquid temperature and accordingly, the chamber adjusts to the unfilled condition and the heating element provides heat to the bottom wall of the container to heat the liquid to the desired liquid temperature.

Figure 2D:
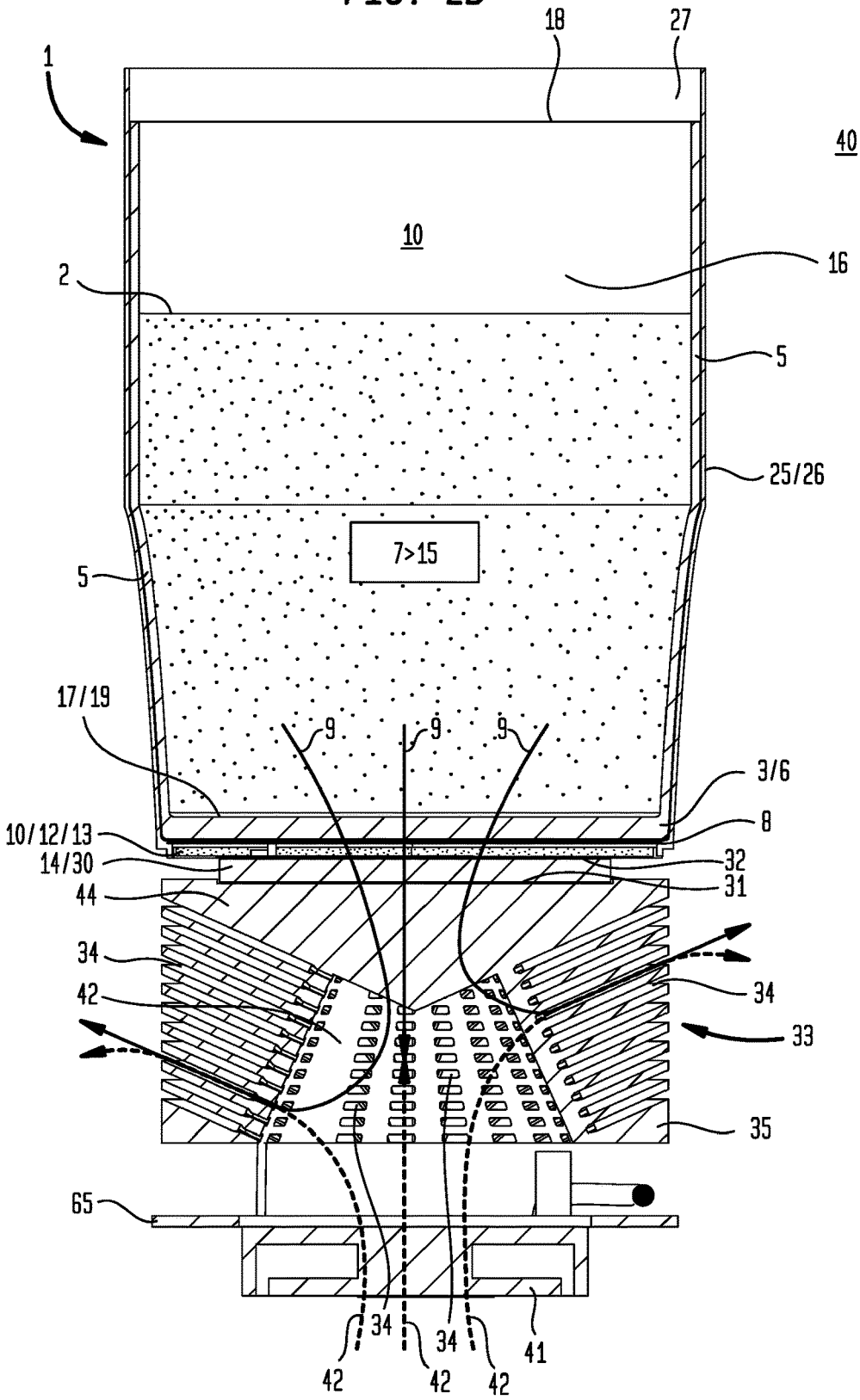

FIG. 2D is a cross-sectional view 2D-2D of the particular embodiment of the instant temperature-regulating containment system shown in FIG. 2B, whereby the liquid temperature of the liquid contained within the internal cavity of the container is above a desired liquid temperature and accordingly, the chamber adjusts to the filled condition and the cooling element removes heat from the bottom wall of the container to cool the liquid to the desired liquid temperature.

Figure 3:
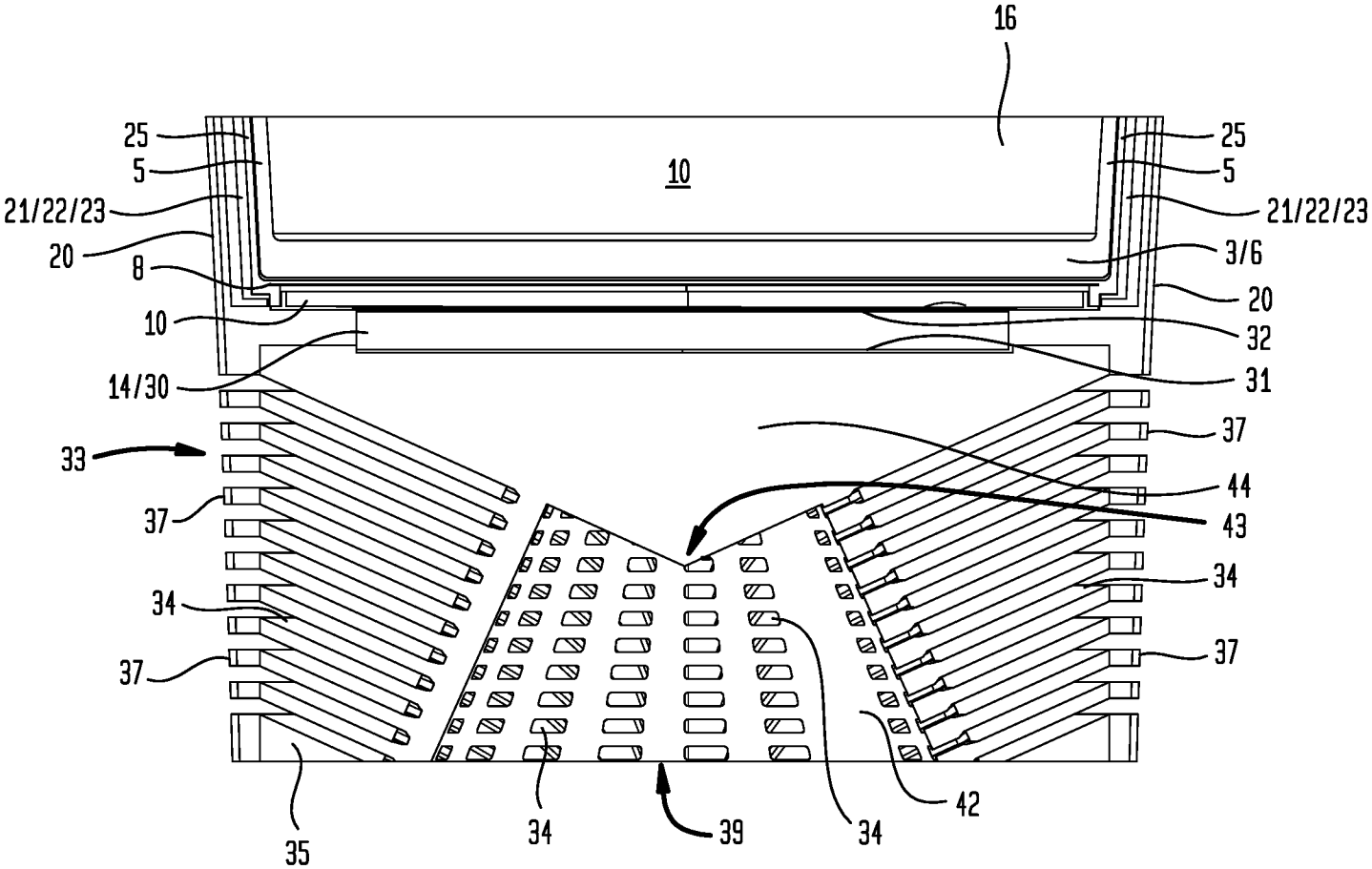

FIG. 3 is an enlarged cross-sectional view of a particular embodiment of the instant temperature-regulating containment system.

Figure 4A:
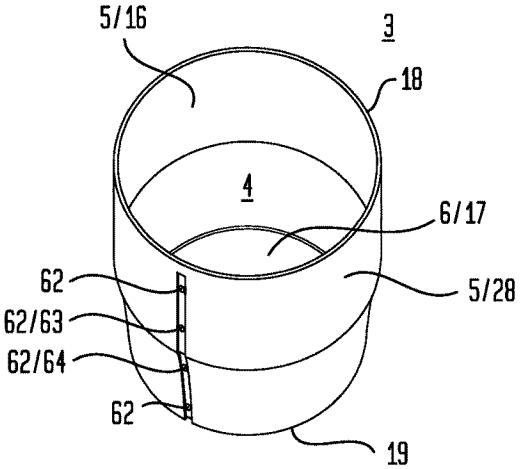

FIG. 4A is a perspective view of a particular embodiment of a container and a sensor of the instant temperature-regulating containment system.

Figure 4B:
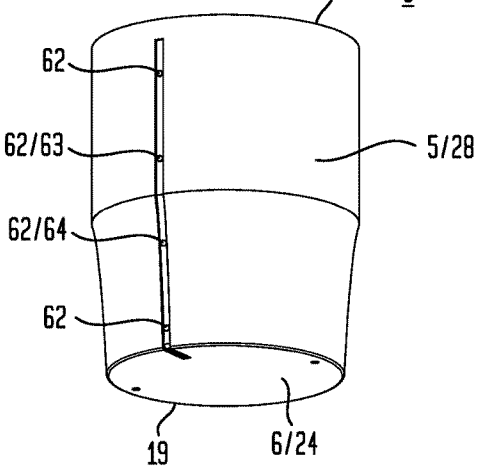

FIG. 4B is a perspective view of a particular embodiment of a container and a sensor of the instant temperature-regulating containment system.

Figure 5A:
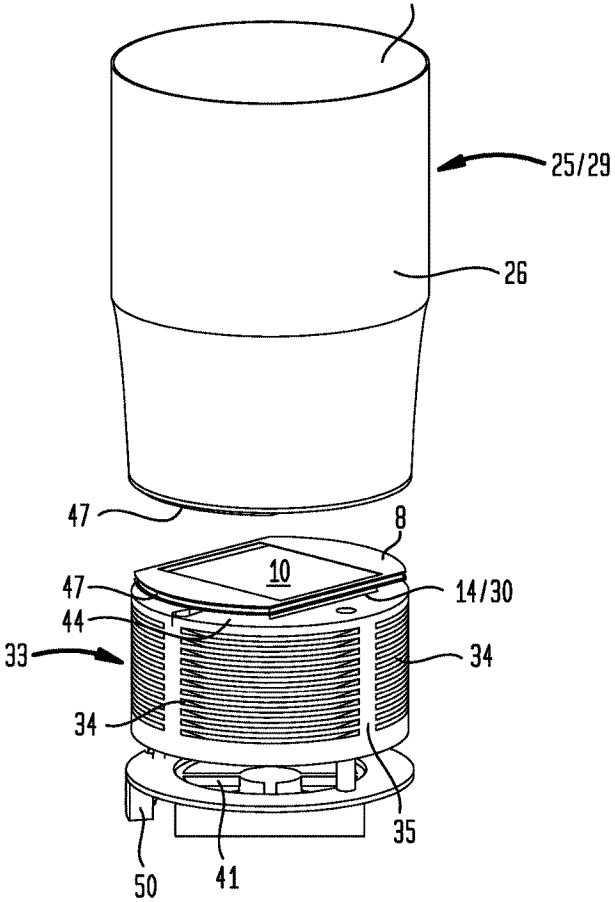

FIG. 5A is a perspective view of a particular embodiment of the instant temperature-regulating containment system with an overlaying layer exploded upwardly from a heating element and a chamber lid.

Figure 5C:
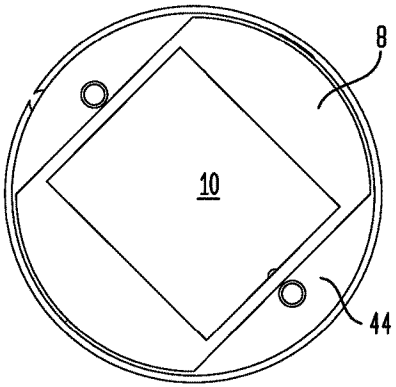
Figure 5B:
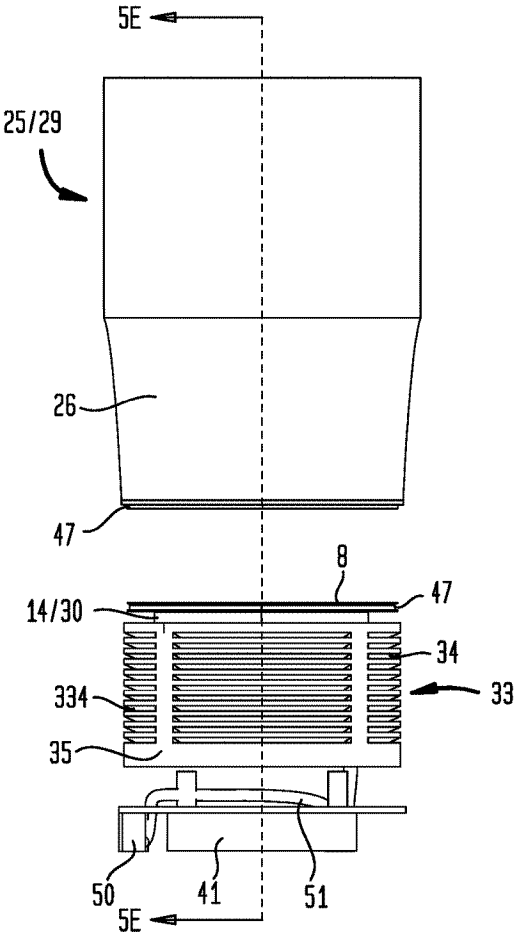

FIG. 5B is a front view of the particular embodiment of the instant temperature-regulating containment system shown in FIG. 5A.

FIG. 5C is a top view of the particular embodiment of the instant temperature-regulating containment system shown in FIG. 5A without the overlaying layer.

Figure 5E:
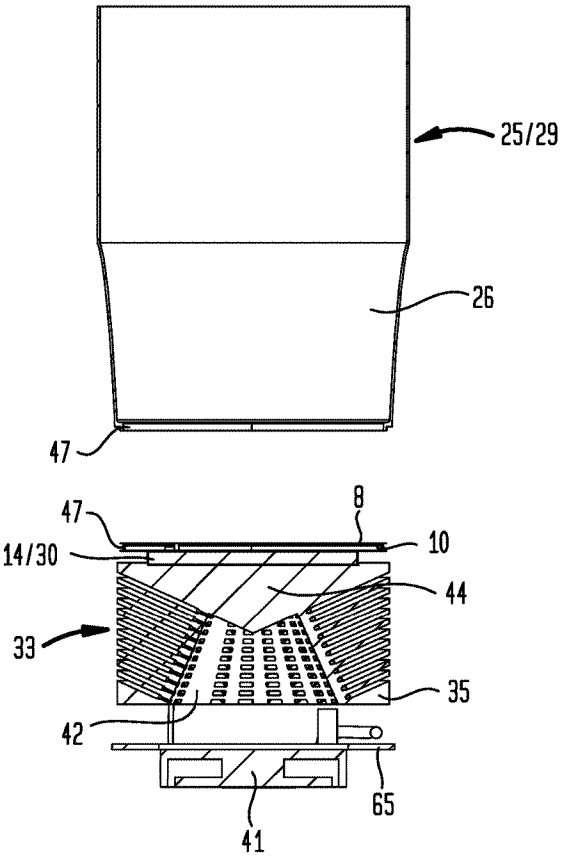
Figure 5D:
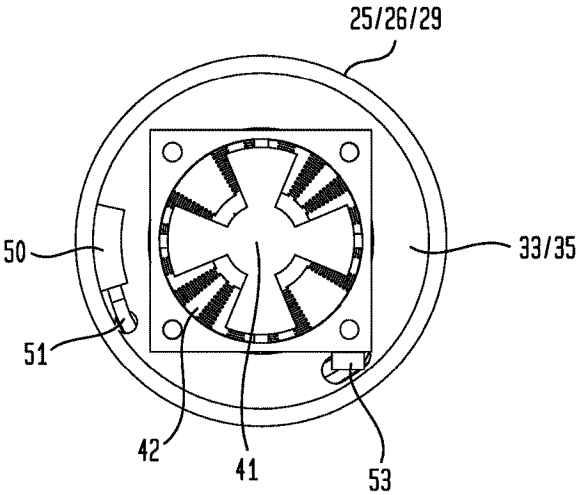

FIG. 5D is a bottom view of the particular embodiment of the instant temperature-regulating containment system shown in FIG. 5A.

FIG. 5E is a cross-sectional view 5E-5E of the particular embodiment of the instant temperature-regulating containment system shown in FIG. 5B.

Figure 6A:
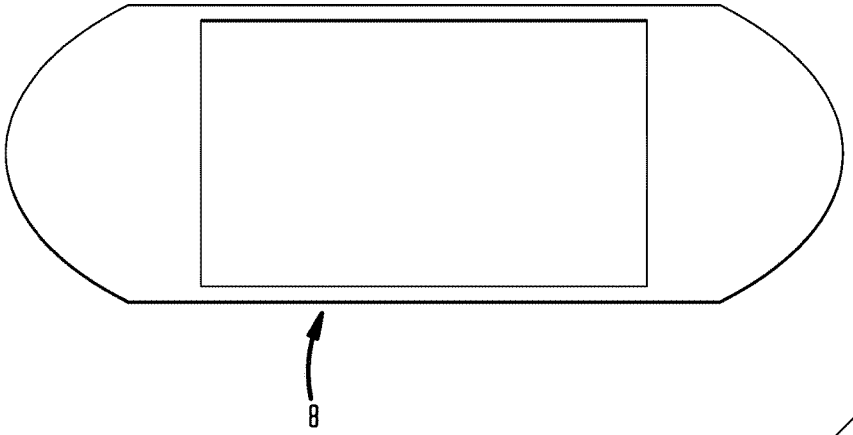

FIG. 6A is a perspective view of a particular embodiment of a heating element of the instant temperature-regulating containment system.

Figure 6B:
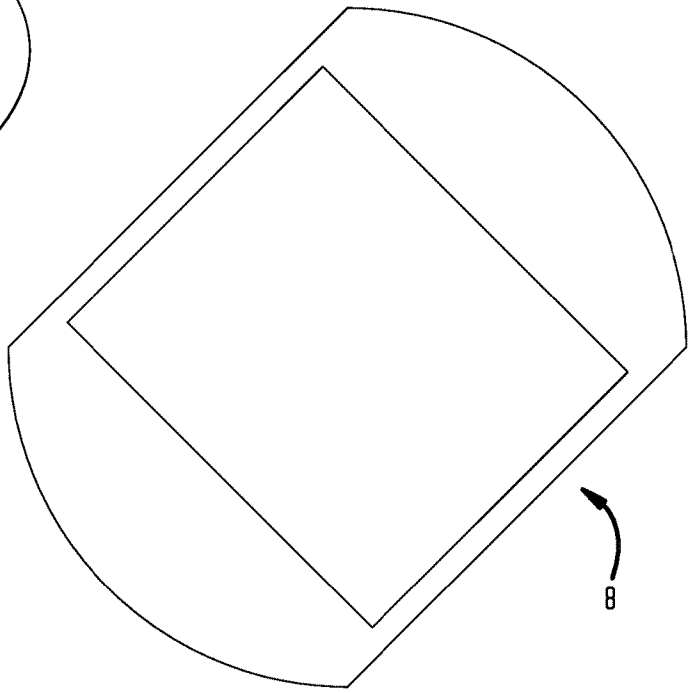

FIG. 6B is a top view of the particular embodiment of the heating element shown in FIG. 6A.

Figure 6C:
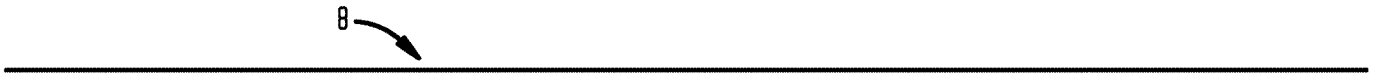

FIG. 6C is a side view of the particular embodiment of the heating element shown in FIG. 6A.

Figure 7A:
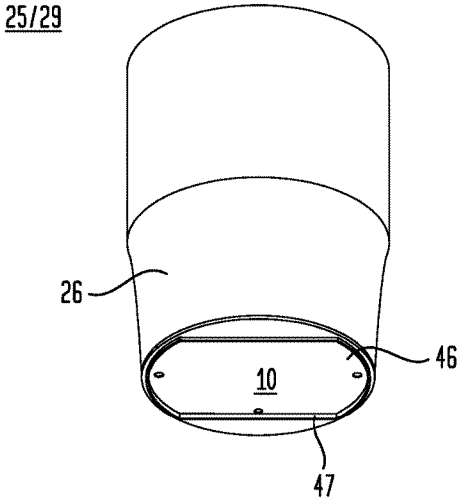

FIG. 7A is a perspective view of a particular embodiment of an overlaying layer of the instant temperature-regulating containment system.

Figure 7B:
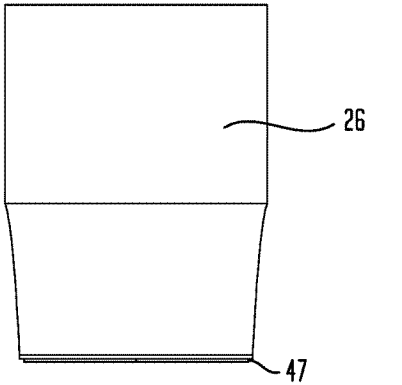

FIG. 7B is a front view of the particular embodiment of the overlaying layer shown in FIG. 7A.

Figure 7C:
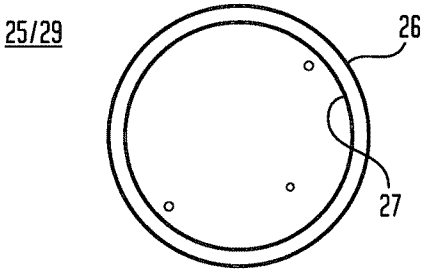

FIG. 7C is a top view of the particular embodiment of the overlaying layer shown in FIG. 7A.

Figure 7D:
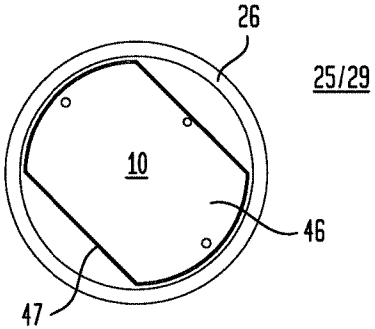

FIG. 7D is a bottom view of the particular embodiment of the overlaying layer shown in FIG. 7A.

Figure 8A:
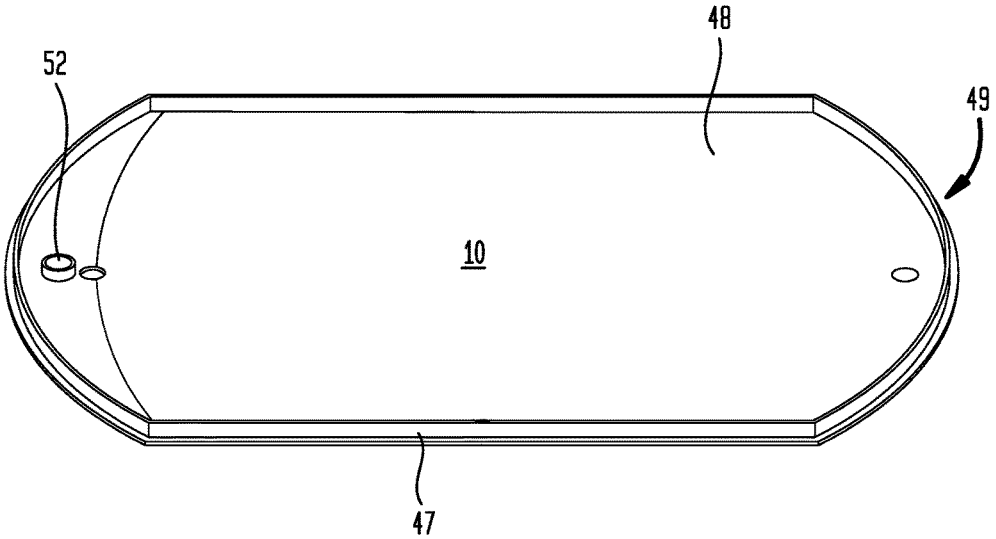

FIG. 8A is a perspective view of a particular embodiment of a chamber lid of the instant temperature-regulating containment system.

Figure 8B:
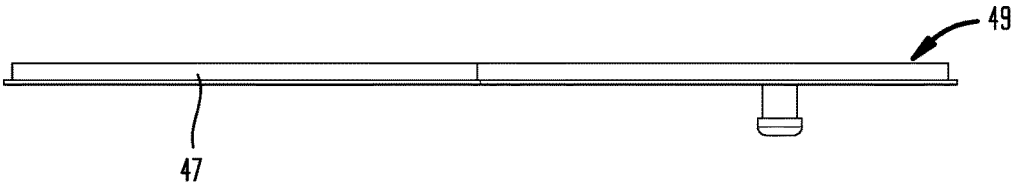

FIG. 8B is a side view of the particular embodiment of the chamber lid shown in FIG. 8A.

Figure 8C:
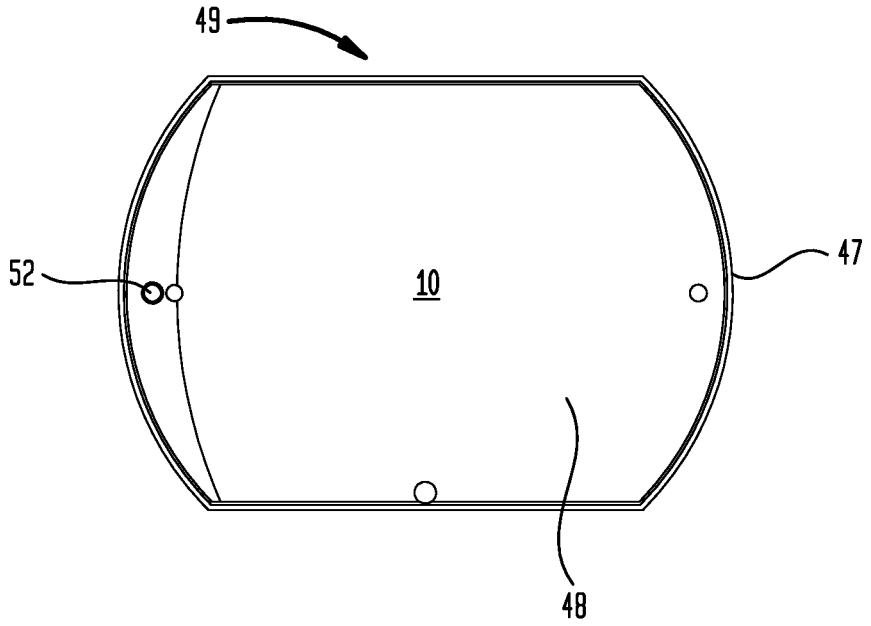

FIG. 8C is a top view of the particular embodiment of the chamber lid shown in FIG. 8A.

Figure 8D:
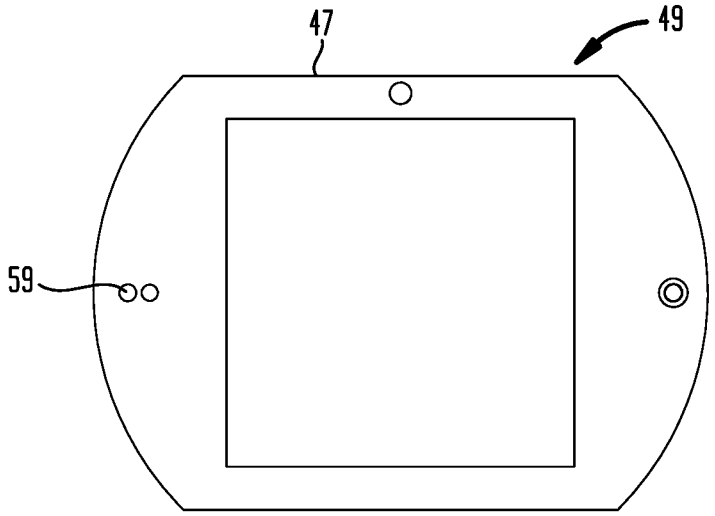

FIG. 8D is a bottom view of the particular embodiment of the chamber lid shown in FIG. 8A.

Figure 8E:
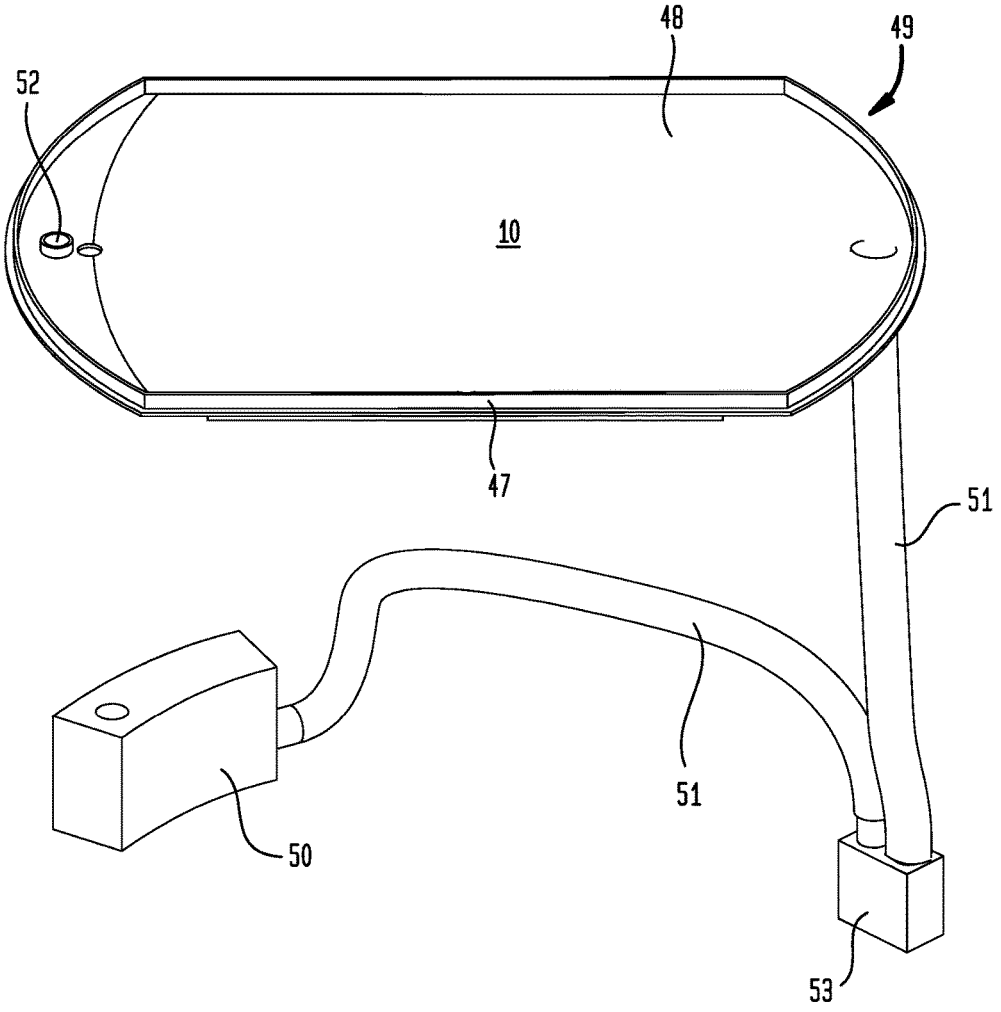

FIG. 8E is a perspective view of a particular embodiment of a chamber lid of the instant temperature-regulating containment system as well as a conduit which fluidicly connects a reservoir and a pump to a chamber partially defined by the chamber lid.

Figure 9:
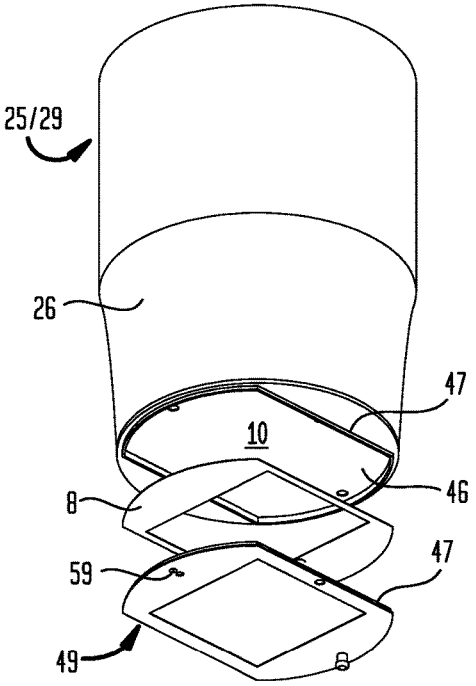

FIG. 9 is a perspective and exploded view of a particular embodiment of an overlaying layer, a heating element, and a chamber lid of the instant temperature-regulating containment system.

Figure 10A:
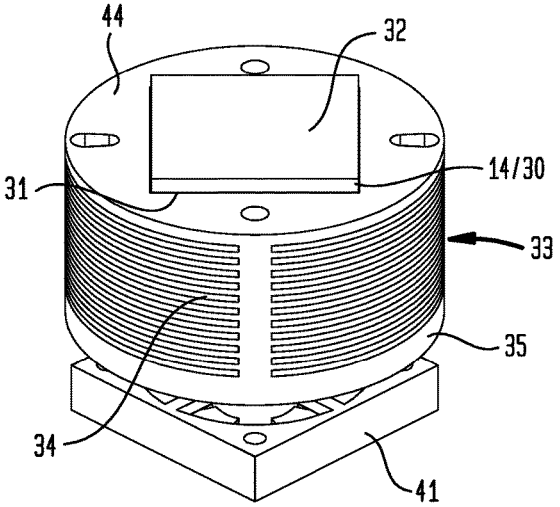

FIG. 10A is a perspective view of a particular embodiment of a cooling element, a heat sink, and a fan of the instant temperature-regulating containment system.

Figure 10B:
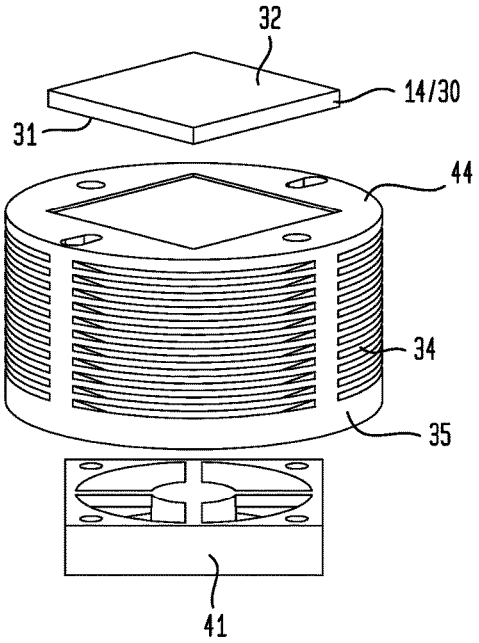

FIG. 10B is an exploded view of the particular embodiment of the cooling element, the heat sink, and the fan shown in FIG. 10A.

Figure 11A:
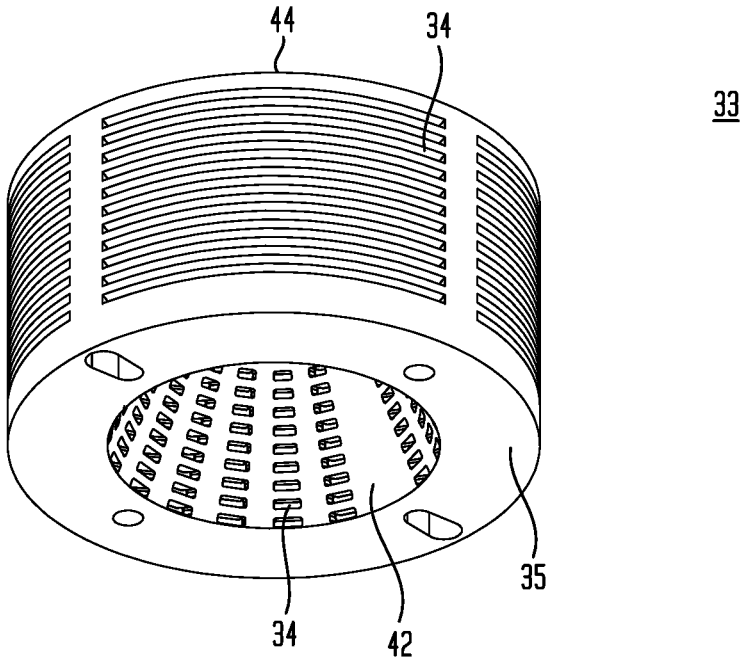

FIG. 11A is a perspective view of a particular embodiment of a heat sink of the instant temperature-regulating containment system.

Figure 11B:
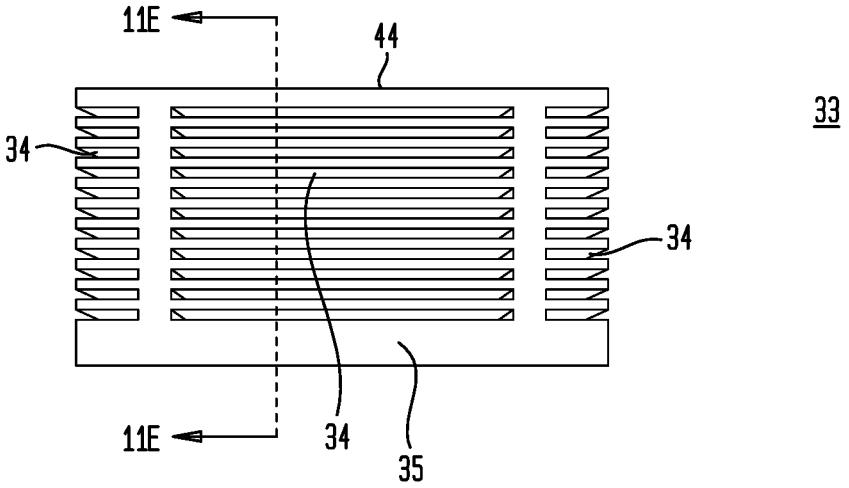

FIG. 11B is a front view of the particular embodiment of the heat sink shown in FIG. 11A.

Figure 11C:
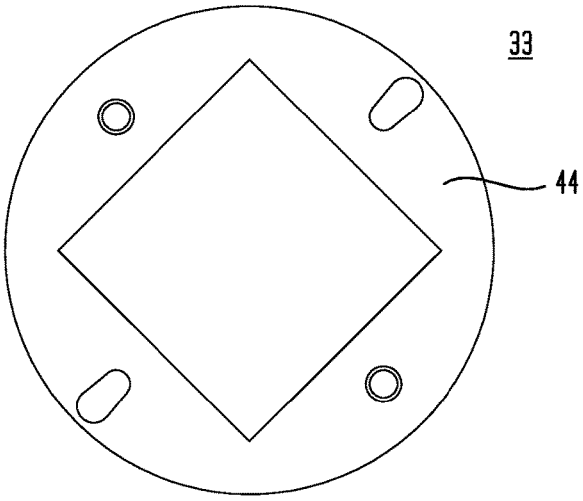

FIG. 11C is a top view of the particular embodiment of the heat sink shown in FIG. 11A.

Figure 11D:
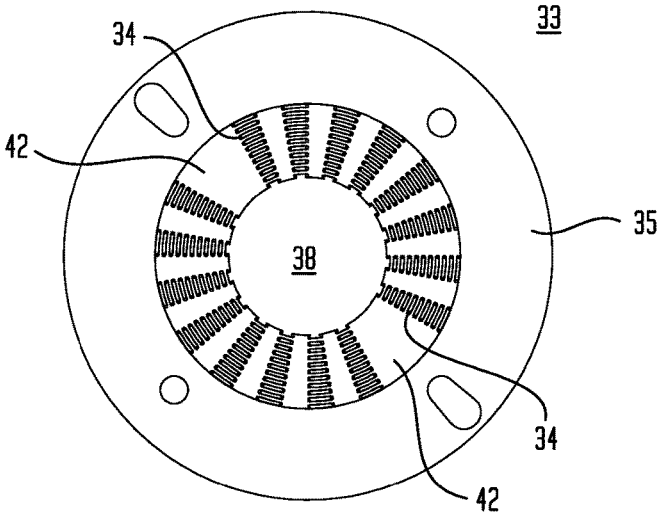

FIG. 11D is a bottom view of the particular embodiment of the heat sink shown in FIG. 11A.

Figure 11E:
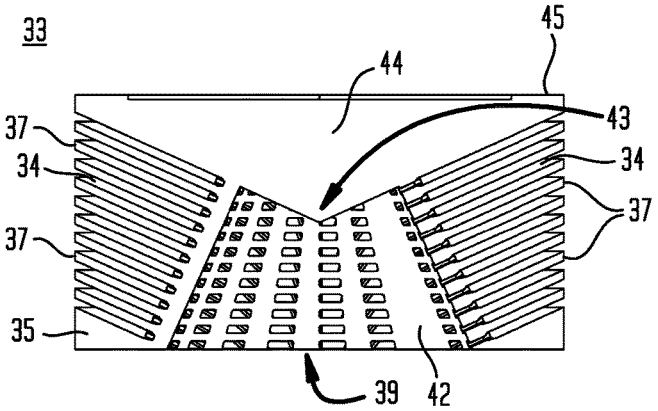

FIG. 11E is a cross-sectional view 11E-11E of the particular embodiment of the heat sink shown in FIG. 11B.

Figure 12B:
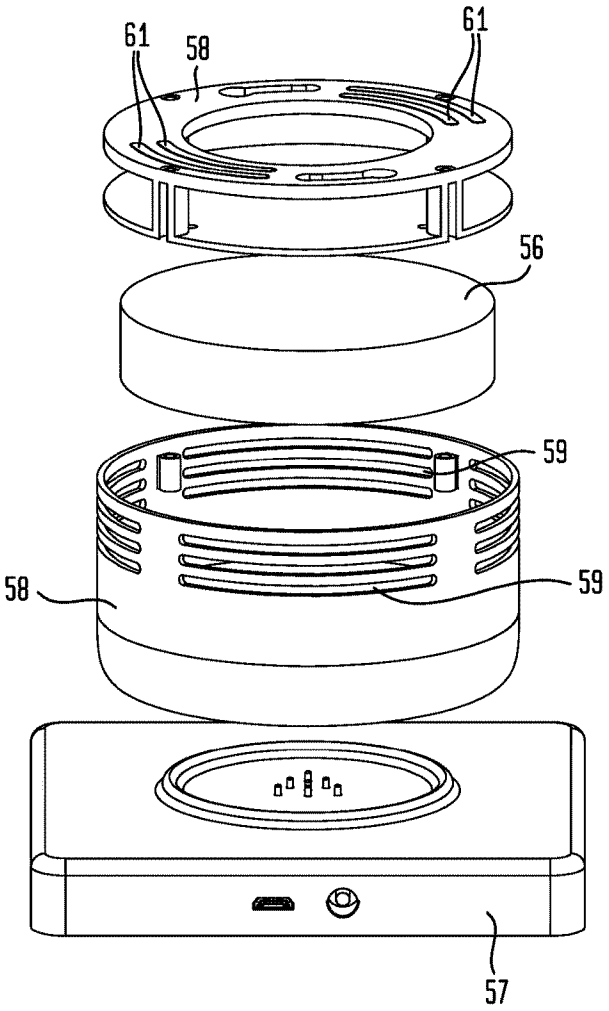
Figure 12A:
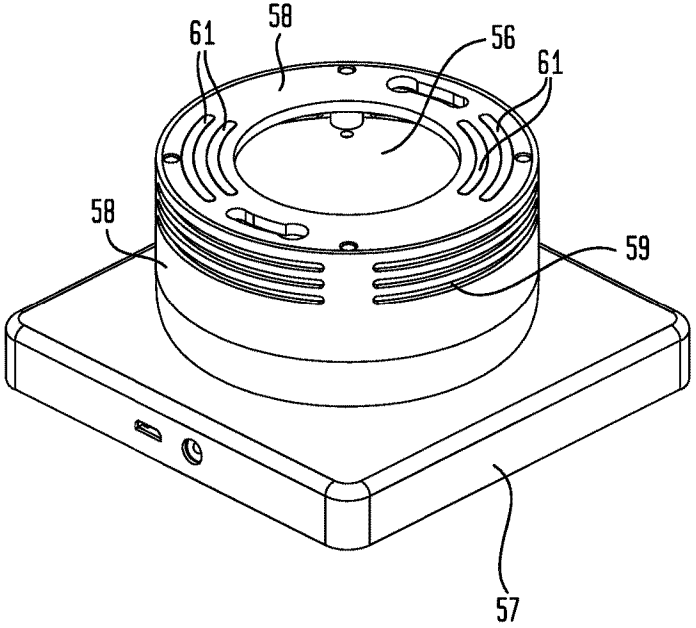

FIG. 12A is a perspective view of a particular embodiment of a power source, a housing, and a charger of the instant temperature-regulating containment system.

FIG. 12B is a perspective and exploded view of the particular embodiment of the power source, the housing, and the charger shown in FIG. 12A.

Figure 12D:
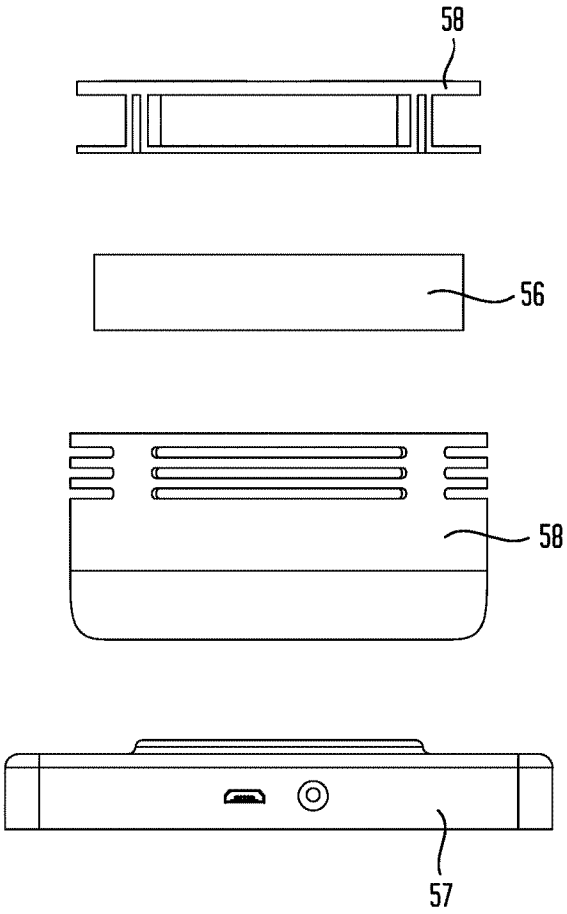
Figure 12C:
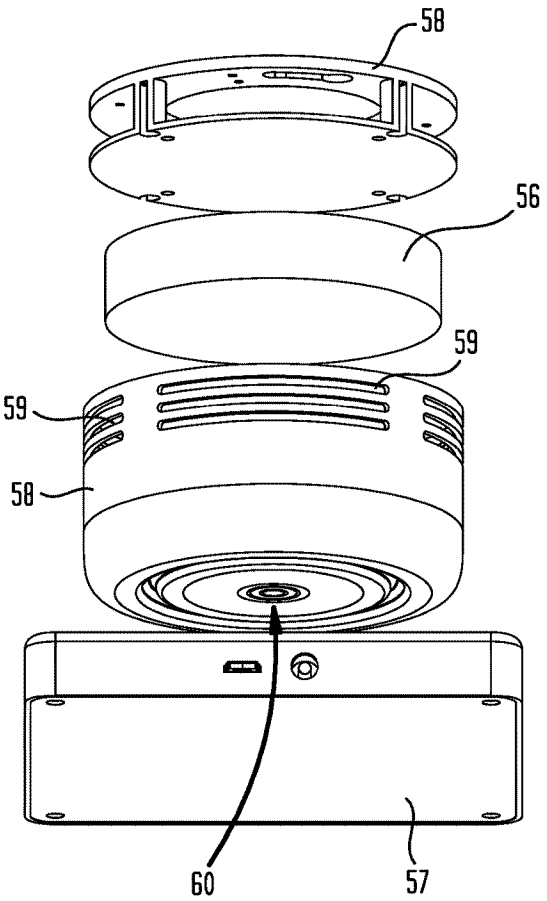

FIG. 12C is a perspective and exploded view of the particular embodiment of the power source, the housing, and the charger shown in FIG. 12A.

FIG. 12D is a front and exploded view of the particular embodiment of the power source, the housing, and the charger shown in FIG. 12A.

Figure 13C:
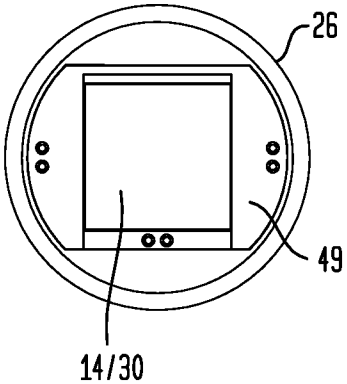
Figure 13B:
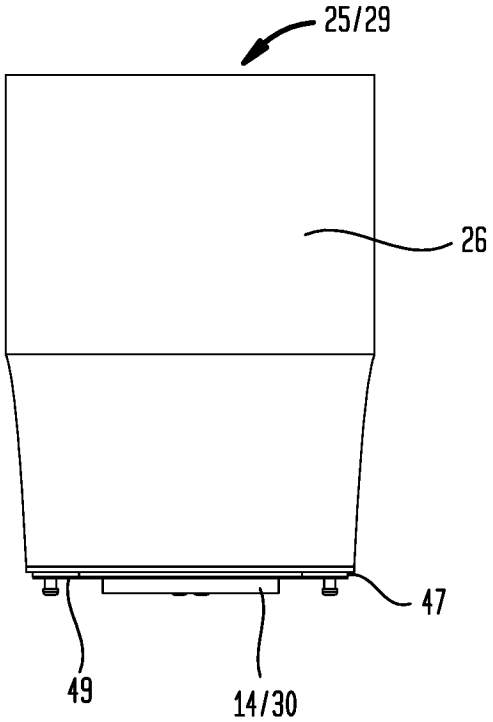
Figure 13A:
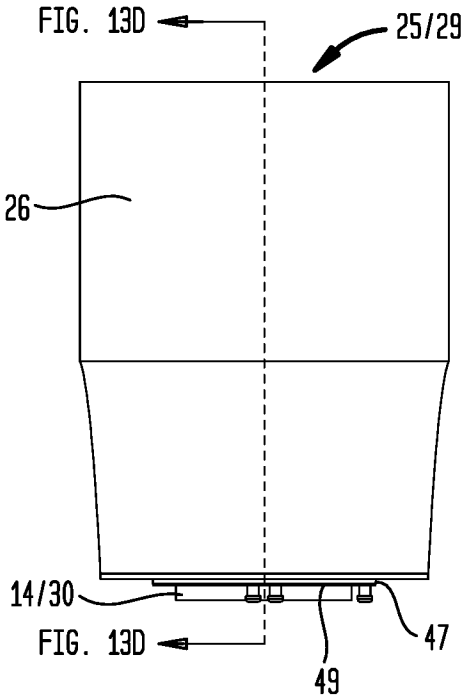

FIG. 13A is a front view of a particular embodiment of the instant temperature-regulating containment system whereby a heating element disposes beneath a first chamber and a cooling element disposes beneath a second chamber.

FIG. 13B is a side view of the particular embodiment of the instant temperature-regulating containment system shown in FIG. 13A.

FIG. 13C is a bottom view of the particular embodiment of the instant temperature-regulating containment system shown in FIG. 13A.

Figure 13D:
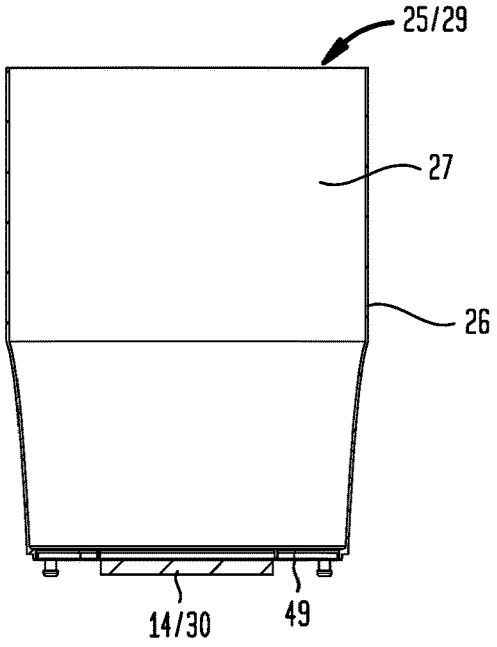

FIG. 13D is a cross-sectional view 13D-13D of the particular embodiment of the instant temperature-regulating containment system shown in FIG. 13A.

Figure 13E:
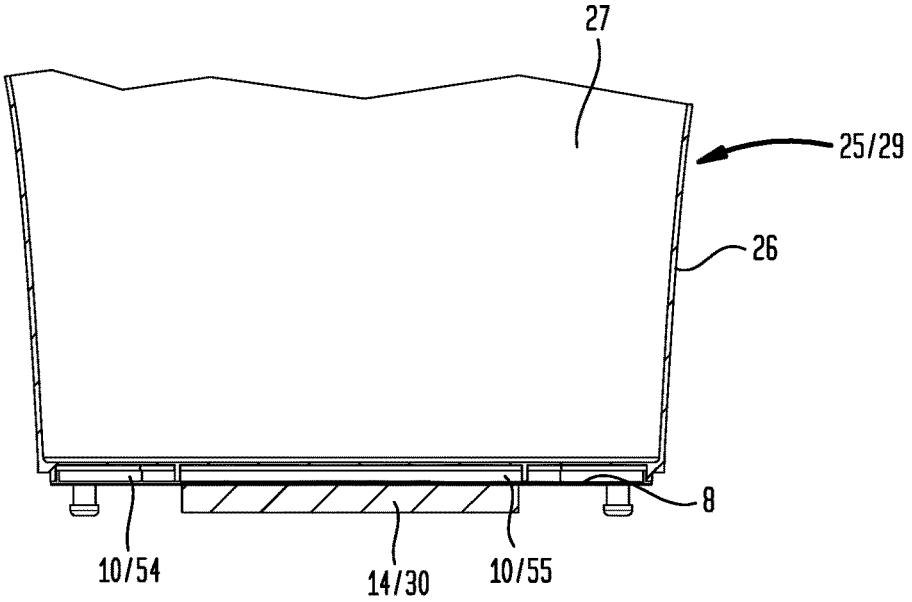

FIG. 13E is an enlarged view of a portion of FIG. 13D.

Figure 14A:
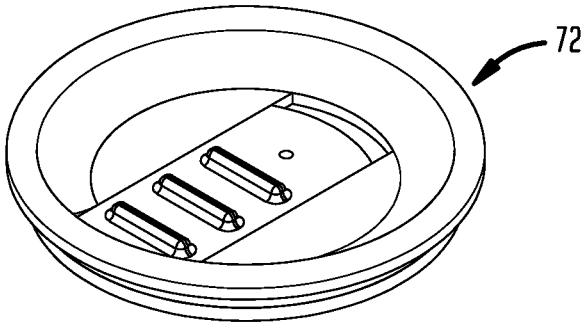

FIG. 14A is a perspective view of a particular embodiment of a lid of the instant temperature-regulating containment system.

Figure 14B:
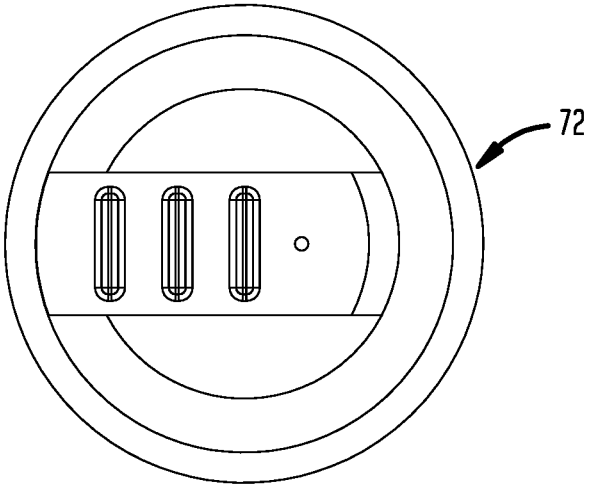

FIG. 14B is a top view of the particular embodiment of the lid shown in FIG. 14A.

Figure 14C:
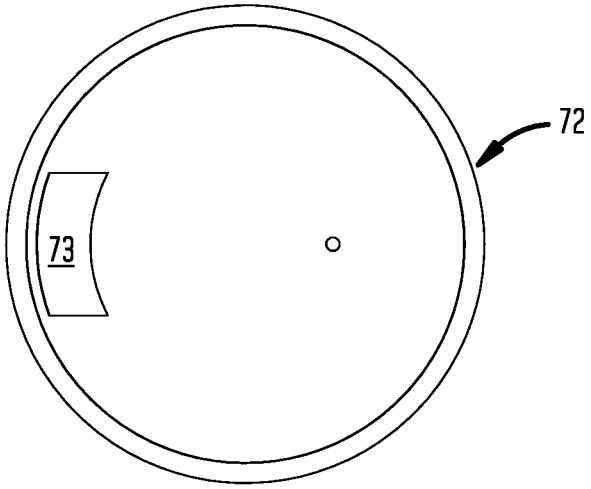

FIG. 14C is a bottom view of the particular embodiment of the lid shown in FIG. 14A.

III. DETAILED DESCRIPTION OF THE INVENTION

Now referring primarily to FIG. 1A through FIG. 2B and FIG. 3, which illustrate a temperature-regulating containment system (1) for actively heating or cooling a liquid (2), the containment system (1) comprising (i) a container (3) having an internal cavity (4) defined by a sidewall (5) upwardly extending from a bottom wall (6), the internal cavity (4) configured to contain liquid (2) which has a liquid temperature (7); (ii) a heating element (8) disposed beneath the bottom wall (6), the heating element (8) configured to provide heat (9) to the bottom wall (6); (iii) a chamber (10) disposed beneath the bottom wall (6), the chamber (10) adjustable between an unfilled condition (11) and a filled condition (12) in which the chamber (10) is filled with a heat transfer medium (13); and (iv) a cooling element (14) disposed beneath the chamber (10), the cooling element (14) configured to remove heat (9) from the bottom wall (6).

Now referring primarily to FIG. 2C, the instant containment system (1) may be useful when the liquid temperature (7) is below a desired liquid temperature (15). Following, the chamber (10) can be adjusted to the unfilled condition (11), and the heating element (8) can provide heat (9) to the bottom wall (6) to heat the liquid (2) to the desired liquid temperature (15).

Now referring primarily to FIG. 2D, the instant containment system (1) may also be useful when the liquid temperature (7) is above a desired liquid temperature (15). Subsequently, the chamber (10) can be adjusted to the filled condition (12), and the cooling element (14) can remove heat (9) from the bottom wall (6) to cool the liquid (2) to the desired liquid temperature (15).

As used herein, the term "heat" means energy, such as thermal energy, which when transferred to matter, can cause the matter to become warmer or hotter. Correspondingly, upon providing heat (9) to matter, the matter can increase in temperature. Conversely, upon removing heat (9) from matter, the matter can decrease in temperature, thereby becoming cooler or colder.

As used herein, a "desired liquid temperature" is typically a predetermined temperature, whereby "predetermined" means decided in advance. Of note, when the desired liquid temperature (15) is reached with use of the instant containment system (1), the applicable heating or cooling element (8)(14) can also function to maintain the desired liquid temperature (15) for a period of time, such as minutes or hours.

As shown in the example of the Figures, the instant containment system (1) or one or more components thereof can be portable, meaning physically configured to be easily carried by an individual during use.

Now referring primarily to FIG. 3, FIG. 4A, and FIG. 4B, the instant containment system (1) includes a container (3) having an internal cavity (4) configured to contain liquid (2), whereby the container (3) is formed from at least a sidewall (5) which upwardly extends from a bottom wall (6). Following, a sidewall inner surface (16) and a bottom wall inner surface (17) define the internal cavity (4) having an open end (18) opposite the bottom wall inner surface (17), which provides the internal cavity (4) with a closed end (19). Liquid (2) can be passed through the open end (18) for containment within the internal cavity (4).

Regarding configuration, as to particular embodiments, the container (3) can be formed from a generally cylindrical sidewall (5), thus having a generally circular cross section through a horizontal plane. The diameter of the generally cylindrical sidewall (5) can be the same or different along the height of the generally cylindrical sidewall (5), depending upon the embodiment. As but one illustrative example shown in the Figures, the diameter of the generally cylindrical sidewall (5) can inwardly taper toward the bottom wall (6).

Regarding material, at least the bottom wall (6) of the container (3) can be formed from a thermally-conductive material, such as metal. As but one non-limiting example, the bottom wall (6) can be formed from copper or copper plated with tin. As to particular embodiments, the sidewall (5), which can be (i) coupled, directly coupled, connected, or adjacent to the bottom wall (6) at a liquid-tight junction or (ii) integrated with the bottom wall (6), can also be formed from a thermally-conductive material as described above.

Now referring primarily to FIG. 1A through FIG. 1G, and FIG. 3, the containment system (1) can further include an outer shell (20) coupled to the container (3), whereby the outer shell (20) surrounds at least the sidewall (5). As to particular embodiments, an insulating element (21) can be disposed between the container (3) and the outer shell (20) (as shown in the example of FIG. 3) to thermally insulate the container (3) and reduce heat transfer therebetween, consequently permitting the liquid (2) to remain at the desired liquid temperature (15) for an increased period of time relative to an embodiment of the containment system (1) without the insulating element (21).

As but one non-limiting example, the insulating element (21) can comprise a vacuum (22). For example, a vacuum (22) can exist in an annular gap (23) between the container (3) and the outer shell (20), the vacuum (22) functioning to thermally insulate the container (3), consequently permitting the liquid (2) to remain at the desired liquid temperature (15) for an increased period of time relative to an embodiment of the containment system (1) without the vacuum (22).

Now referring primarily to FIG. 5A through FIG. 6C, the containment system (1) further includes a heating element (8) disposed beneath the bottom wall (6), whereby the heating element (8) is configured to provide heat (9) to the bottom wall (6). Thus, the heating element (8) is in thermal communication with the bottom wall (6) and can correspondingly provide heat (9) to the bottom wall (6) and subsequently, to the liquid (2) contained within the internal cavity (4) via transfer through the bottom wall (6) to heat the liquid (2) to the desired liquid temperature (15).

It is herein to be understood that when a component of the containment system (1) is in thermal communication with the bottom wall (6) of the container (3), the component is also in thermal communication with the liquid (2) contained within the internal cavity (4). Thus, when heat (9) is provided to the bottom wall (6), for example by the heating element (8), heat (9) is provided to the liquid (2) contained within the internal cavity (4). And, when heat (9) is removed from the bottom wall (6), for example by the cooling element (14), heat (9) is removed from the liquid (2) contained within the internal cavity (4).

As to particular embodiments, the heating element (8) can include an electrically-conductive path having a sufficient amount of resistance to generate heat (9) upon travel of electricity, whereby the electrically-conductive path can take the form of a wire, ribbon, strip, etched path, or the like, depending upon the embodiment.

As to particular embodiments, the heating element (8) and/or the electrically-conductive path can be generally planar or flat, as shown in the examples of the Figures.

As to particular embodiments, the heating element (8) can be configured as a flexible heating element (8).

Now referring primarily to FIG. 3, the heating element (8) can be coupled, directly coupled, connected, or adjacent to a bottom wall outer surface (24) disposed opposite the bottom wall inner surface (17) which defines a portion of the internal cavity (4).

As to particular embodiments, the heating element (8) can be connected to the bottom wall outer surface (24) by adhesion, for example via a thermally conductive adhesive, disposing the heating element (8) adjacent to the bottom wall outer surface (24) (not shown).

Now referring primarily to FIG. 3, FIG. 5A, FIG. 5B, and FIG. 5E, as to other particular embodiments, the heating element (8) can be connected or adhered to a component which itself disposes adjacent to the bottom wall outer surface (24), thereby positioning the heating element (8) proximate the bottom wall outer surface (24). As but one illustrative example, the heating element (8) can be connected or adhered to an overlaying layer (25) which overlays or is directly adjacent to the bottom wall outer surface (24). Specifically, the heating element (8) can be connected or adhered to an overlaying layer outer surface (26), whereby the opposing overlaying layer inner surface (27) can be directly adjacent to the bottom wall outer surface (24). As but one illustrative example, the overlaying layer (25) can be formed from a thermally-conductive material, such as steel, thus allowing heat (9) to transfer therethrough from the heating element (8) to the bottom wall (6).

Now referring primarily to FIG. 3, as to particular embodiments, the overlaying layer (25) can overlay the bottom wall outer surface (24) and a sidewall outer surface (28) such that the overlaying layer (25) is configured as an open-ended vessel (29) which contains the above-described container (3).

Now referring primarily to FIG. 3, FIG. 5A through FIG. 5E, FIG. 10A, and FIG. 10B, the containment system (1) further includes a cooling element (14) disposed beneath the bottom wall (6), whereby the cooling element (14) is configured to remove heat (9) from the bottom wall (6). Thus, the cooling element (14) is in thermal communication with the bottom wall (6), and can correspondingly remove heat (9) from the bottom wall (6) and subsequently, from the liquid (2) contained within the internal cavity (4) via transfer through the bottom wall (6) to cool the liquid (2) to the desired liquid temperature (15).

As to particular embodiments, the cooling element (14) can be a thermoelectric cooler, such as a Peltier device (30) which operates according to the Peltier effect. Typically, a Peltier device (30) includes a warmable face (31) opposite a coolable face (32). When an electric current flows through the Peltier device (30), heat transfers from the coolable face (32) to the warmable face (31), thus decreasing the temperature of (or cooling) the coolable face (32) and increasing the temperature of (or warming) the warmable face (31).

Now referring primarily to FIG. 3, the Peltier device (30) can be disposed beneath the bottom wall (6) such that the coolable face (32) is proximate the bottom wall (6) while the warmable face (31) is distal from the bottom wall (6). Said another way, the coolable face (32) can be oriented toward the bottom wall (6) or closer to the bottom wall (6), and the warmable face (31) can be oriented away from the bottom wall (6) or farther from the bottom wall (6). Accordingly, during use of the containment system (1), the coolable face (32) can be upwardly-directed while the warmable face (31) can be downwardly directed. Following, the coolable face (32) can be in thermal communication with the bottom wall (6), and can correspondingly remove heat (9) from the bottom wall (6) and subsequently, from the liquid (2) contained within the internal cavity (4) via transfer through the bottom wall (6) to cool the liquid (2) to the desired liquid temperature (15).

Now referring primarily to FIG. 3, FIG. 5A through FIG. 5E, and FIG. 10A through FIG. 11E, the containment system (1) can further include a heat sink (33) coupled, directly coupled, connected, or adjacent to the Peltier device (30). Specifically, the heat sink (33) can be coupled, directly coupled, connected, or adjacent to the warmable face (31) of the Peltier device (30) such that the heat sink (33) is in thermal communication with the warmable face (31). Correspondingly, the heat sink (33) can function to dissipate heat (9) transferred to the warmable face (31) from the coolable face (32), thus allowing the warmable face (31) to draw additional heat (9) from the coolable face (32) to further decrease the temperature of (or cool) the coolable face (32). Consequently, the temperature of the bottom wall (6) can be further decreased (or cooled) and subsequently, the liquid (2) contained within the internal cavity (4) can be cooled to the desired liquid temperature (15).

Now referring primarily to FIG. 11E, the heat sink (33) can include one or more fluid flow paths (34) disposed within a heat sink body (35) formed from a thermally-conductive material, such as aluminum or copper. The fluid flow paths (34) can be configured to allow a fluid medium (36), such as air, to flow therethrough, whereby heat (9) from the relatively warmer heat sink body (35) can be transferred to the relatively cooler fluid medium (36) which upon flowing, can transfer the heat (9) away from the heat sink (33) and the containment system (1). Preferably, the heat sink body (35) and fluid flow paths (34) can be configured to maximize the surface area of the heat sink body (35) which contacts the fluid medium (36) to increase the amount of heat (9) which can be transferred away from the heat sink (33) and the containment system (1).

Again referring primarily to FIG. 11E, the fluid flow paths (34) can be defined by fins (37) of the heat sink body (35), whereby the fins (37) and correspondingly, the fluid flow paths (34), radially outwardly and upwardly extend from an interior fluid flow channel (38) in spaced apart relation. Correspondingly, from proximate an interior fluid flow channel bottom portion (39), a fluid medium (36) can flow upward and outward through the interior fluid flow channel (38) and the fluid flow paths (34) toward the ambient environment (40) to transfer heat (9) from the heat sink body (35) to the ambient environment (40).

Additionally, a liquid fluid medium (36), such as water, can flow through the fluid flow paths (34) and the interior fluid flow channel (38), either upwardly or downwardly, which may be useful for cleaning and/or washing the heat sink (33).

Now referring primarily to FIG. 5A through FIG. 5E, FIG. 10A, and FIG. 10B, as to particular embodiments, the containment system (1) can further include a fan (41) fluidicly coupled to the interior fluid flow channel (38), the fan (41) functioning to facilitate movement or flow of the fluid medium (36), such as air, upward and outward through the interior fluid flow channel (38) and the fluid flow paths (34) toward the ambient environment (40), thereby transferring heat (9) from the heat sink body (35) to the ambient environment (40).

As to particular embodiments, the fan (41) can be disposed proximate the interior fluid flow channel bottom portion (39). As but one non-limiting example, the fan (41) can be disposed, either partially or entirely, within the interior fluid flow channel bottom portion (39) such that a heat sink body internal wall (42) which defines the interior fluid flow channel (38) surrounds the fan (41). As but a second non-limiting example, the fan (41) can be disposed beneath the interior fluid flow channel bottom portion (39), as shown in the examples of the Figures.

Now referring primarily to FIG. 11E, as to particular embodiments, the heat sink body internal wall (42) which defines the interior fluid flow channel (38) can have a generally conical shape such that the heat sink body internal wall (42) inwardly tapers toward an interior fluid flow channel top portion (43) or outwardly tapers toward the interior fluid flow channel bottom portion (39).

Again referring primarily to FIG. 11E, as to particular embodiments, the heat sink body (35) can further include a heat storage element (44) disposed proximate a heat sink upper portion (45), whereby the heat storage element (44) may be useful for storing heat (9), for example heat (9) transferred from the warmable face (31) of the Peltier device (30), and consequently, may preclude the heat sink (33) from heating too rapidly.

Now referring primarily to FIG. 2A, FIG. 2B, FIG. 3, FIG. 5A through FIG. 5E, and FIG. 7A through FIG. 9, the containment system (1) further includes a chamber (10) disposed beneath the bottom wall (6) and above the cooling element (14) or between the bottom wall (6) and the cooling element (14), whereby the chamber (10) can be coupled, directly coupled, connected, or adjacent to the bottom wall (6) and/or the cooling element (14), depending upon the embodiment.

As to particular embodiments, the chamber (10) can be disposed within or formed by a component which itself disposes adjacent to the bottom wall outer surface (24), thereby positioning the chamber (10) proximate the bottom wall outer surface (24). As but one illustrative example, the chamber (10) can be disposed within or integrated with the overlaying layer (25) which overlays or is directly adjacent to the bottom wall outer surface (24). Specifically, the chamber (10) can have a chamber upper portion (46) which is defined by the overlaying layer outer surface (26). Further, the overlaying layer outer surface (26) can define chamber sidewalls (47) which extend between the chamber upper portion (46) and a chamber lower portion (48), which can be closed by a removable chamber lid (49).

As to particular embodiments having an overlaying layer (25) configured as an open-ended vessel (29) which contains the container (3), the chamber (10) can be disposed within or formed by the open-ended vessel (29).

The chamber (10) is adjustable between an unfilled condition (11) and a filled condition (12) in which the chamber (10) is filled with a heat transfer medium (13) which can thermally communicate with the bottom wall (6) and the cooling element (14). Thus, when the chamber (10) is in the filled condition (12), the heat transfer medium (13) functions to thermally couple the bottom wall (6) and the cooling element (14), meaning that heat (9) can transfer between the bottom wall (6) and the cooling element (14). Conversely, when the chamber (10) is in the unfilled condition (11) and void of the heat transfer medium (13), the bottom wall (6) is thermally uncoupled from the cooling element (14), meaning that heat (9) is precluded from transferring between the bottom wall (6) and the cooling element (14).

As to particular embodiments, a vacuum (22) can be generated within the chamber (10) when the chamber (10) is adjusted to the unfilled condition (11). The vacuum (22) which exists within the chamber (10) can function to thermally uncouple the bottom wall (6) and the cooling element (14); thus, the vacuum (22) precludes heat (9) from transferring between the bottom wall (6) and the cooling element (14).

Now referring primarily to FIG. 2A, FIG. 2B, and FIG. 5A through FIG. 5E, as to particular embodiments, a reservoir (50) can be fluidicly coupled to the chamber (10), for example via a conduit (51), such that the heat transfer medium (13) can be transferred between the chamber (10) and the reservoir (50) to provide the unfilled and filled conditions (11)(12) of the chamber (10).

Following, to achieve the unfilled condition (11) of the chamber (10), the heat transfer medium (13) can be transferred from the chamber (10) to the reservoir (50) for storage within the reservoir (50). In contrast, to achieve the filled condition (12) of the chamber (10), the heat transfer medium (13) can be transferred from the reservoir (50) to the chamber (10), whereby the heat transfer medium (13) can displace air in the chamber (10), the air egressing from the chamber (10) via a port (52) (as shown in the examples of FIG. 8A, FIG. 8C, and FIG. 8D) which can include a hydrophobic membrane to allow passage of air and preclude passage of the heat transfer medium (13).

It is herein to be understood that the heat transfer medium (13) is a flowable medium capable of flowing between the chamber (10) and the reservoir (50). As but one non-limiting example, the heat transfer medium (13) can comprise or consist of a liquid, such as mineral oil or the like.

Again referring primarily to FIG. 2A, FIG. 2B, and FIG. 5A through FIG. 5E, as to particular embodiments, a pump (53) can be operatively coupled to the chamber (10) and the reservoir (50), whereby the pump (53) can facilitate transfer of the heat transfer medium (13) between the chamber (10) and the reservoir (50).

Regarding spatial relationships, the cooling element (14) disposes beneath the chamber (10) and, in this way, the chamber (10) can function to thermally uncouple or thermally couple the bottom wall (6) and the cooling element (14) when in the unfilled and filled conditions (11)(12), respectively. However, the heating element (8) can dispose either above the chamber (10) or beneath the chamber (10), depending upon the embodiment.

Now referring primarily to FIG. 5A through FIG. 6C, as to particular embodiments wherein the heating element (8) disposes above the chamber (10) or above a majority of the chamber (10), such as in embodiments whereby the heating element is connected or adhered to an overlaying layer outer surface (26) and the overlaying layer outer surface (26) defines the chamber upper portion (46), the heating element (8) can include a through-hole (54), for example a centrally-located through-hole (54), permitting the chamber upper portion (46) to extend through the through-hole to directly contact the overlaying layer outer surface (26). Following, when the chamber (10) is in the filled condition (12), the heat transfer medium (13) can directly contact the overlaying layer outer surface (26) for unimpeded thermal communication. Thus, in this embodiment, both the heating element (8) and the chamber (10) are in direct thermal communication with the overlaying layer outer surface (26).

Now referring primarily to FIG. 13A through FIG. 13E, as to other particular embodiments, the heating element (8) can dispose beneath the chamber (10) or beneath a majority of the chamber (10). As to these particular embodiments, the chamber (10) can be divided into discrete first and second chambers (54)(55), whereby the heating element (8) can dispose beneath the first chamber (54) and the cooling element (14), for example the Peltier device (30), can dispose beneath the second chamber (55). The first chamber (54) can function to thermally uncouple or thermally couple the heating element (8) and the bottom wall (6) when in the unfilled and filled conditions (11)(12), respectively; and, the second chamber (55) can function to thermally uncouple or thermally couple the cooling element (14) and the bottom wall (6) when in the unfilled and filled conditions (11)(12), respectively.

Now referring primarily to FIG. 1A through FIG. 1G, and FIG. 12A through FIG. 12D, the containment system (1) can further include a power source (56) operatively and/or electrically coupled to one or more powerable components of the containment system (1), whereby a powerable component can be any component requiring power to perform its intended function, including but not limited to: the heating element (8), the cooling element (14), the fan (41), and the pump (53).

As to particular embodiments, the power source (56) can be removable or configured to removably couple to the container (3), which may be useful when cleaning and/or washing the containment system (1).

As to particular embodiments, the power source (56) can be rechargeable and for example, can be charged by a charger (57).

As to particular embodiments, the power source (56) can be removable and rechargeable.

As to particular embodiments, the power source (56) can be configured as a battery, such as a rechargeable battery.

As to particular embodiments, the power source (56) can be disposed beneath the container (3). Further, as to particular embodiments, the power source (56) can be disposed beneath the heat sink (33).

As to particular embodiments, the power source (56) can be housed in a housing (58).

As to particular embodiments, the housing (58) can be removable or configured to removably couple to the container (3), which may be useful when cleaning and/or washing the containment system (1).

As to particular embodiments, the housing (58) can be disposed beneath the container (3). Further, as to particular embodiments, the housing (58) can be disposed beneath the heat sink (33).

As to particular embodiments, the housing (58) can include one or more vents (59), which may be useful for channeling air from the ambient environment (40) to the fan (41) for directed upward and outward flow through the interior fluid flow channel (38) and the fluid flow paths (34) toward the ambient environment (40) to transfer heat (9) from the heat sink body (35) to the ambient environment (40).

Now referring primarily to FIG. 12C, as to particular embodiments, the housing (58) can include one or more first electrical connections (60) which function to electrically couple the power source (56) to the charger (57) to recharge the power source (56).

Now referring primarily to FIG. 12B, as to particular embodiments, the housing (58) can include one or more second electrical connections (61) which function to electrically couple the power source (56) to one or more powerable components of the containment system (1).

Now referring primarily to FIG. 4A and FIG. 4B, the containment system (1) can further include one or more sensors (62) configured to sense a parameter of the liquid (2) and/or a parameter of the containment system (1) and communicate sensed parameter information to control circuitry which functions to control one or more controllable components of the containment system (1), whereby a controllable component may be a powerable component as described above, based at least in part on the sensed parameter information.

As to particular embodiments, the sensor (62) can be a temperature sensor (62) configured to sense the liquid temperature (7), whether directly or indirectly. Regarding the latter, the temperature sensor (62) can be connected to an outer surface of a container wall (5)(6), such as sidewall outer surface (28), whereby the temperature sensor (62) senses the temperature of the sidewall outer surface (28) which can serve as a surrogate for the liquid temperature (7). Of note, in this embodiment, the temperature sensor (62) does not contact the liquid (2) within the internal cavity (4).

Following, the sensed temperature information can be communicated to the control circuitry, which may result in operation of the heating element (8) if the liquid temperature (7) is determined to be below a desired liquid temperature (15) or operation of the cooling element (14) if the liquid temperature (7) is determined to be above a desired liquid temperature (15).

As to particular embodiments, the containment system (1) can include a plurality of temperature sensors (62) disposed in spaced apart relation along a height of the container (3). By determining the difference between the sensed temperature information provided by at least two sensors (62) in generally vertical spaced apart relation, the level of the liquid (2) can be determined, such as via use of a liquid volume algorithm.

For example, when liquid (2) is present in the internal cavity (4), if there is substantially no difference between the sensed temperature information provided by upper and lower temperature sensors (63)(64), the level of the liquid (2) may likely be above the upper temperature sensor (63). However, if the sensed temperature information provided by the upper temperature sensor (63) indicates a lesser temperature than that provided by the lower temperature sensor (64), the level of the liquid (2) may likely be below the upper temperature sensor (63) and above the lower temperature sensor (64) or between the upper and lower temperature sensors (63)(64).

Additionally, when no liquid (2) is detected via the plurality of temperature sensors (62), the containment system (1) can be configured to power off.

Now referring primarily to FIG. 5A through FIG. 5E, the control circuitry which, stated again, functions to control one or more controllable components of the containment system (1) based at least in part on the sensed parameter information, can include at least one controller or microcontroller (65) which can receive, process, and transform a sensor signal generated by a sensor (62).

Now referring primarily to FIG. 1A through FIG. 1G, as to particular embodiments, the containment system (1) can further include a display surface (66) operatively coupled to the control circuitry, whereby the display surface (66) can be configured to display the liquid temperature (7) or information, such as a message, notification, or visual indication, related to the liquid temperature (7).

Again referring primarily to FIG. 1A through FIG. 1G, as to particular embodiments, the display surface (66) can be located on the containment system (1).

Again referring primarily to FIG. 1A through FIG. 1G, as to particular embodiments, the containment system (1) can further include a user interface (67) operatively coupled to the control circuitry and having one or more user-actuatable controls (68) to provide operating instructions to the control circuitry. For example, a user-actuatable control (68) may be used to select a desired liquid temperature (15) of the liquid (2) within the internal cavity (4) and correspondingly, one or more controllable components of the containment system (1) will operate to achieve the desired liquid temperature (15).

Again referring primarily to FIG. 1A through FIG. 1G, as to particular embodiments, the user interface (67) and correspondingly, the one or more user-actuatable controls (68), can be located on the containment system (1). Thus, the one or more user-actuatable controls (68) can be actuated locally to control one or more controllable components of the containment system (1).

Figure 1A:
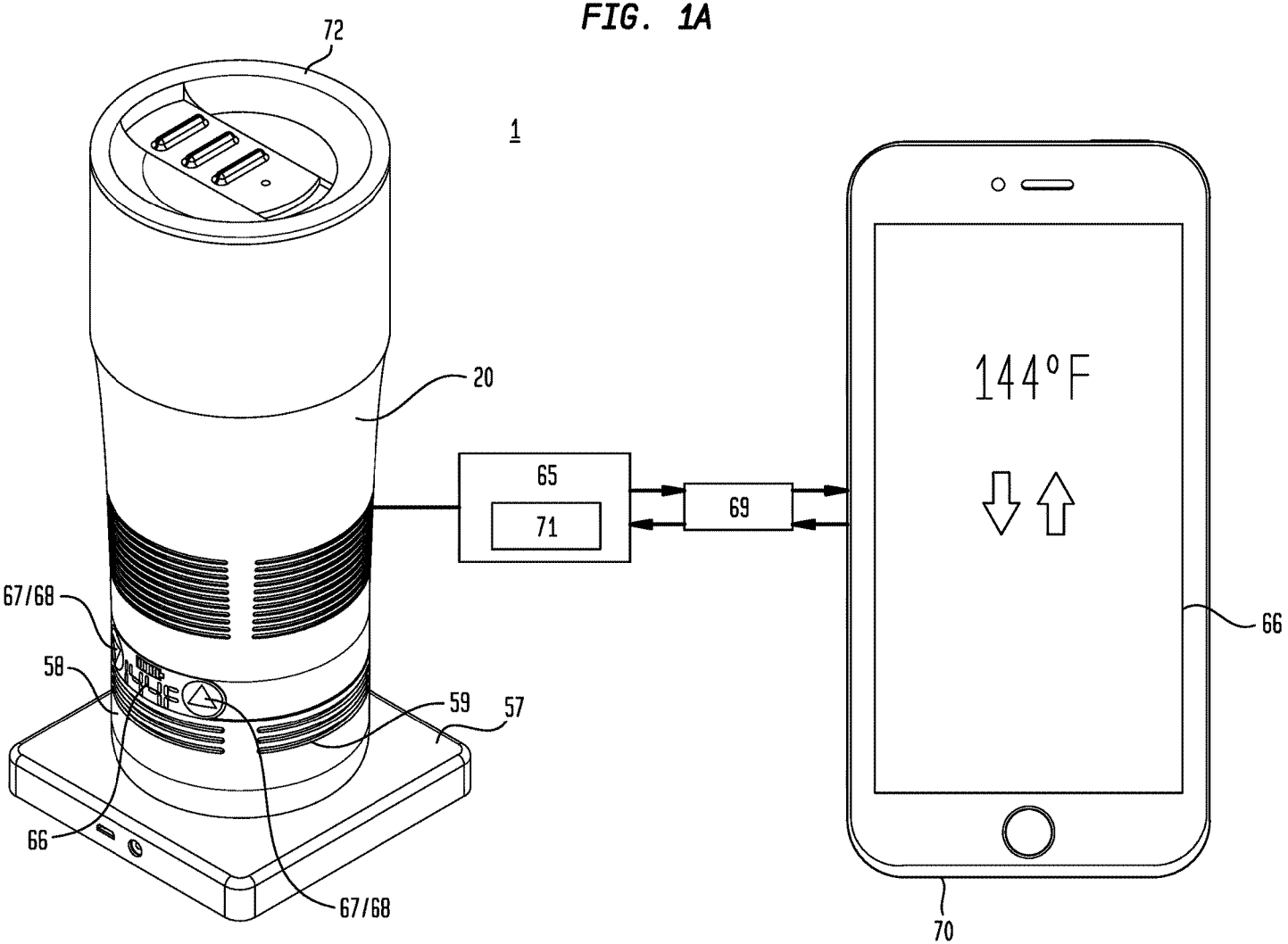
FIG. 1A is a perspective view of a particular embodiment of the instant temperature-regulating containment system.
Figure 1C:
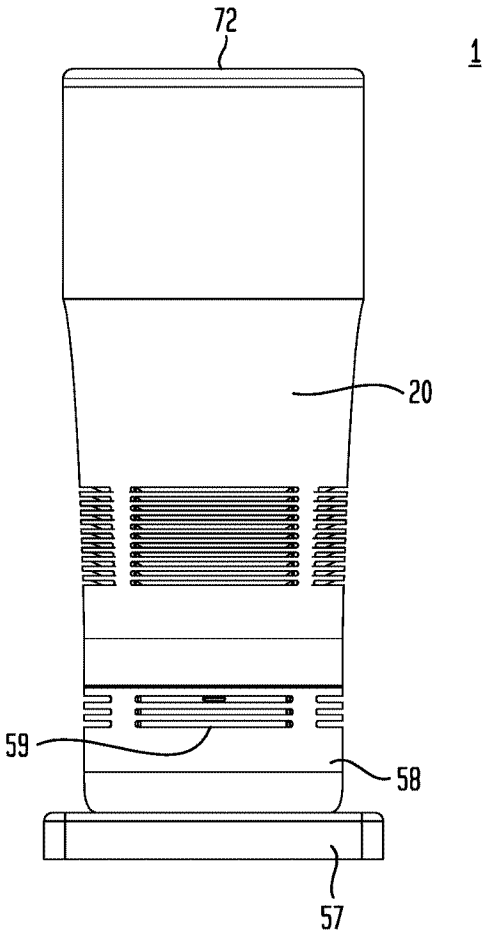
FIG. 1C is a rear view of the particular embodiment of the instant temperature-regulating containment system shown in FIG. 1A.
Figure 1B:
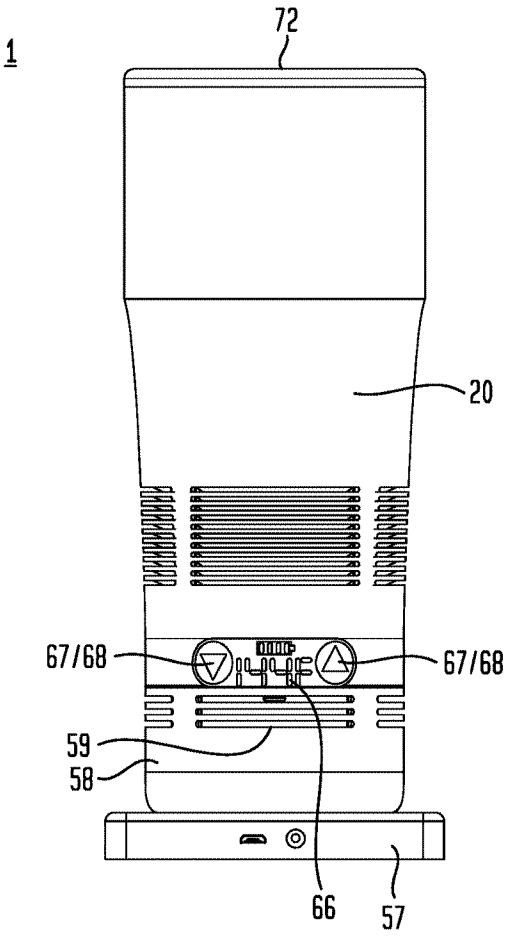
FIG. 1B is a front view of the particular embodiment of the instant temperature-regulating containment system shown in FIG. 1A.
Figure 1E:
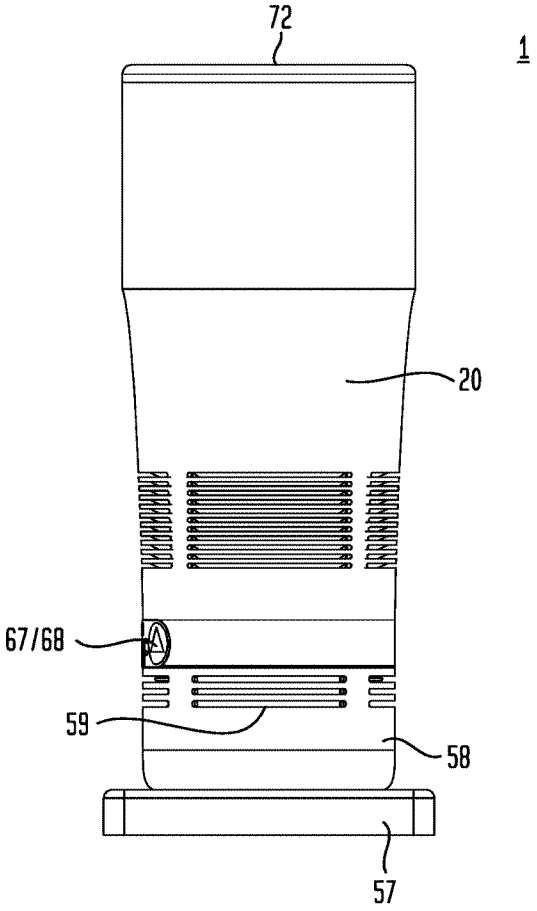
FIG. 1E is a second side view of the particular embodiment of the instant temperature-regulating containment system shown in FIG. 1A.
Figure 1D:
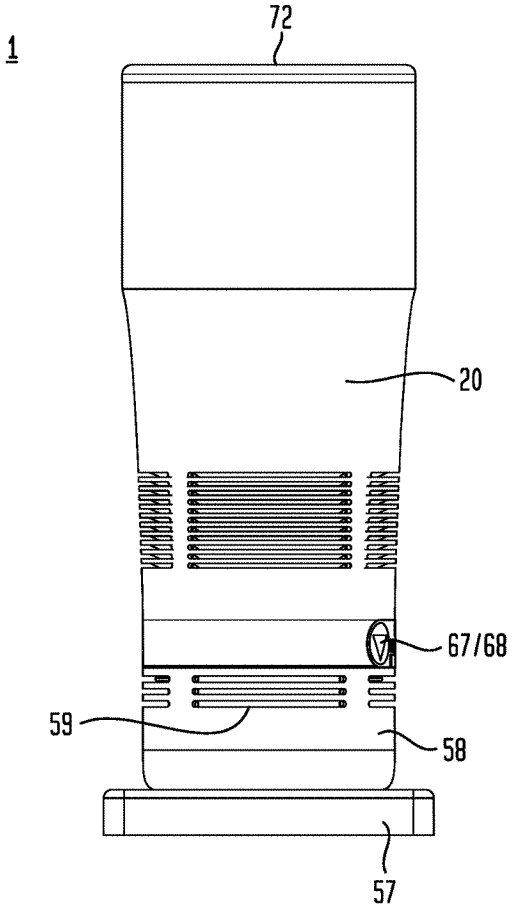
FIG. 1D is a first side view of the particular embodiment of the instant temperature-regulating containment system shown in FIG. 1A.
Figure 1F:
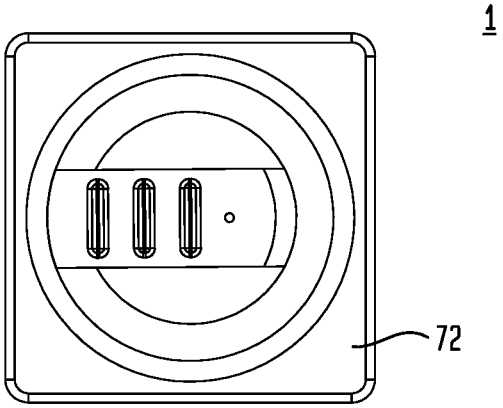
FIG. 1F is a top view of the particular embodiment of the instant temperature-regulating containment system shown in FIG. 1A.
Figure 1G:
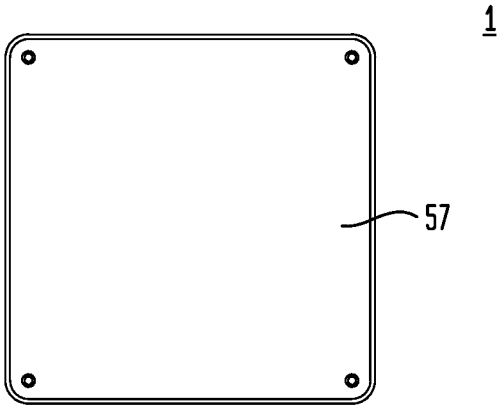
FIG. 1G is a bottom view of the particular embodiment of the instant temperature-regulating containment system shown in FIG. 1A.

Now referring primarily to FIG. 1A, as to particular embodiments, the containment system (1) can further include a wireless transceiver (69) operatively coupled to the control circuitry, the transceiver (69) configured to establish a communication connection with a remote device (70), such as a mobile electronic device like a mobile phone or tablet computer.

As to particular embodiments, the transceiver (69) can be configured to transmit information, for example the liquid temperature (7) or information related to the liquid temperature (7), to the remote device (70), whereby the liquid temperature (7) or information related to the liquid temperature (7) can subsequently be displayed on the remote device (70). Thus, as to this particular embodiment, the display surface (66) can be located on the remote device (70).

As to particular embodiments, the transceiver (69) can also be configured to receive operating instructions from the remote device (70), for example instructions to operate one or more controllable components of the containment system (1) to achieve the desired liquid temperature (15). Accordingly, as to this particular embodiments, the user interface (67) and correspondingly, the one or more user-actuatable controls (68), can be located on the remote device (70). Thus, the one or more user-actuatable controls (68) can be actuated remotely to control one or more controllable components of the containment system (1).

As to particular embodiments, the remote device (70) can comprise a program or application (71) associated with the containment system (1), whereby the application (71) can include information related to the liquid temperature (7), such as recommended temperatures for specific liquid types. Additionally, the application (71) can function to store temperature preferences of a user, for example the user's temperature preferences for specific liquid types.

Now referring primarily to FIG. 1A through FIG. 1G and FIG. 14A through FIG. 14C, the containment system (1) can further include a lid (72) configured to sealably engage with the container (3), whereby the lid (72) can include at least one opening (73) through which liquid (2) can flow, allowing a user to drink the liquid (2) contained within the internal cavity (4) without having to disengage the lid (72) from the container (3).

Now regarding production, a method of making the instant temperature-regulating containment system (1) can include providing a container (3) having an internal cavity (4) defined by a sidewall (5) upwardly extending from a bottom wall (6), the internal cavity (4) configured to contain liquid (2) which has a liquid temperature (7); disposing a heating element (8) beneath the bottom wall (6), the heating element (8) configured to provide heat (9) to the bottom wall (6); disposing a chamber (10) beneath the bottom wall (6), the chamber (10) adjustable between an unfilled condition (11) and a filled condition (12) in which the chamber (10) is filled with a heat transfer medium (13); and disposing a cooling element (14) beneath the chamber (10), the cooling element (14) configured to remove heat (9) from the bottom wall (6). When the liquid temperature (7) is below a desired liquid temperature (15), the chamber (10) can be adjusted to the unfilled condition (11), and the heating element (8) can provide heat (9) to the bottom wall (6) to heat the liquid (2) to the desired liquid temperature (15). Further, when the liquid temperature (7) is above a desired liquid temperature (15), the chamber (10) can be adjusted to the filled condition (12), and the cooling element (14) can remove heat (9) from the bottom wall (6) to cool the liquid (2) to the desired liquid temperature (15).

The method of making the containment system (1) can further include providing additional components of the containment system (1) as described above and in the claims.

Now regarding utilization, a method of using the instant temperature-regulating containment system (1) to achieve a desired liquid temperature (15) of a liquid (2) can include obtaining the containment system (1) described above; containing liquid (2) within the internal cavity (4); adjusting the chamber (10) to one of (i) the unfilled condition (11) or (ii) the filled condition (12); and operating one of (i) the heating element (8) to provide heat (9) to the bottom wall (6) to heat the liquid (2) to the desired liquid temperature (15) or (ii) the cooling element (14) to remove heat (9) from the bottom wall (6) to cool the liquid (2) to the desired liquid temperature (15).

The method of using the containment system (1) can further include utilizing additional components of the containment system (1) as described above and in the claims.

As to particular embodiments, the method of using the containment system (1) to cool the liquid (2) contained within the internal cavity (4) to the desired liquid temperature (15) can include a first step of adjusting the chamber (10) to the filled condition (12) and operating the cooling element (14) to remove heat (9) from the bottom wall (6) to decrease the liquid temperature (7). If the desired liquid temperature (15) is not achieved because operation of the cooling element (14) cannot provide further cooling of the liquid (2), a second step can ensue, whereby the cooling element (14) can be powered off and the chamber (10) can be adjusted to the unfilled condition (11) while the heat sink (33) continues to dissipate heat (9). Following dissipation of a desired amount if heat (9), for example when the heat sink (33) equilibrates with ambient temperature, the first step can be repeated, namely the chamber (10) can again be adjusted to the filled condition (12) and the cooling element (14) can again be operated to remove heat (9) from the bottom wall (6) to decrease the liquid temperature (7). If the desired liquid temperature (15) is still not achieved, the second step can be repeated, particularly the cooling element (14) can again be powered off and the chamber (10) can again be adjusted to the unfilled condition (11) while the heat sink (33) continues to dissipate heat (9). The first and second steps can continually repeat until the desired liquid temperature (15) is achieved.

As can be easily understood from the foregoing, the basic concepts of the present invention may be embodied in a variety of ways. The invention involves numerous and varied embodiments of a temperature-regulating containment system and methods for making and using such a temperature-regulating containment system.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "heat" should be understood to encompass disclosure of the act of "heating"—whether explicitly discussed or not—and, conversely, were there effectively disclosure of the act of "heating", such a disclosure should be understood to encompass disclosure of "heat" and even a "means for heating". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the temperature-regulating containment systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A temperature-regulating containment system for actively heating or cooling a liquid to a desired liquid temperature, comprising:

a container having an internal cavity defined by a sidewall upwardly extending from a bottom wall, said internal cavity configured to contain said liquid which has a liquid temperature;

a heating element disposed beneath said bottom wall, said heating element configured to provide heat to said bottom wall;

a chamber disposed beneath said bottom wall, said chamber adjustable between an unfilled condition and a filled condition in which said chamber is filled with a heat transfer medium; and a cooling element disposed beneath said chamber, said cooling element configured to remove heat from said bottom wall; wherein when said liquid temperature is below said desired liquid temperature: said chamber adjusts to said unfilled condition; and said heating element provides said heat to said bottom wall to heat said liquid to said desired liquid temperature; and wherein when said liquid temperature is above said desired liquid temperature: said chamber adjusts to said filled condition; and said cooling element removes said heat from said bottom wall to cool said liquid to said desired liquid temperature;

further comprising one or more sensors operatively coupled to said containment system; wherein at least one said sensor comprises a temperature sensor which provides sensed temperature information;

further comprising a display surface operatively coupled to said control circuitry;

further comprising control circuitry which controls one or more controllable components of said containment system based at least in part on said sensed temperature information;

further comprising a wireless transceiver operatively coupled to said control circuitry;

wherein said transceiver is configured to establish a communication connection with a remote device; wherein said remote device comprises an application associated with said containment system.

2. The containment system of claim 1, wherein said heating element is coupled to a bottom wall outer surface of said bottom wall.

3. The containment system of claim 1, wherein said cooling element comprises a thermoelectric cooler.

4. The containment system of claim 3, wherein said cooling element comprises a Peltier device having a warmable face opposite a coolable face.

5. The containment system of claim 4, wherein said coolable face is proximate said bottom wall and said warmable face is distal from said bottom wall.

6. The containment system of claim 4, further comprising a heat sink coupled to said warmable face of said Peltier device, said heat sink in thermal communication with said warmable face.

7. The containment system of claim 1, wherein said chamber is disposed between said bottom wall and said cooling element.

8. The containment system of claim 7, wherein when said chamber is in said filled condition, said heat transfer medium thermally communicates with said bottom wall and said cooling element.

9. The containment system of claim 8, wherein when said chamber is in said unfilled condition, said bottom wall is thermally uncoupled from said cooling element.

10. The containment system of claim 9, wherein a vacuum exists in said chamber when said chamber is in said unfilled condition.

11. The containment system of claim 1, further comprising a power source operatively coupled to one or more powerable components of said containment system.

12. The containment system of claim 1, further comprising a plurality of said temperature sensors disposed in spaced apart relation along a height of said container.

13. The containment system of claim 12, whereby said sensed temperature information provides a sensed liquid level of said liquid within said internal cavity.

14. The containment system of claim 1, further comprising a display surface operatively coupled to said control circuitry;

wherein said display surface displays said liquid temperature or information related to said liquid temperature.

15. The containment system of claim 1, further comprising a user interface operatively coupled to said control circuitry;

wherein said user interface comprises one or more user-actuatable controls to provide operating instructions to said control circuitry.

* * * * *